US006467209B1

(12) United States Patent
Vickers

(10) Patent No.: US 6,467,209 B1
(45) Date of Patent: Oct. 22, 2002

(54) OVERHEAD MEDIA DISPLAY SYSTEM

(76) Inventor: Thomas M. Vickers, 2523 Arborview Dr., Morrisville, NC (US) 27560

( * ) Notice: Subject to any disclaimer, the term of this patent is extended or adjusted under 35 U.S.C. 154(b) by 0 days.

(21) Appl. No.: 09/442,351

(22) Filed: Nov. 17, 1999

(51) Int. Cl.[7] ..... G09F 7/18
(52) U.S. Cl. ..... 40/617; 52/762; 52/764
(58) Field of Search ..... 40/617, 606, 610, 40/540, 554, 571, 646, 553, 618; 52/474, 762, 764; 160/135, 351

(56) References Cited

U.S. PATENT DOCUMENTS

| | | | | | |
|---|---|---|---|---|---|
| 569,764 | A | | 10/1896 | Nason | |
| 978,218 | A | * | 12/1910 | Sargent | 40/617 |
| 2,871,598 | A | * | 2/1959 | Pawelka | 40/617 |
| 4,075,775 | A | * | 2/1978 | Shorette | 40/553 |
| 4,229,913 | A | * | 10/1980 | Corrigan | 40/617 |
| 4,290,218 | A | * | 9/1981 | Drueck, Jr. | 40/553 |
| 4,716,671 | A | | 1/1988 | Gross | 40/558 |
| 4,856,216 | A | | 8/1989 | Gross | 40/559 |
| 4,947,570 | A | * | 8/1990 | May et al. | 40/553 |
| 5,025,355 | A | | 6/1991 | Harwood | 362/147 |
| 5,128,850 | A | | 7/1992 | Juodvalkis | 362/352 |
| 5,154,014 | A | | 10/1992 | Groy et al. | 40/431 |
| 5,274,938 | A | * | 1/1994 | McDonald et al. | 40/617 |
| 5,282,331 | A | | 2/1994 | Fell | 40/617 |
| 5,355,604 | A | | 10/1994 | Rathke | 40/601 |
| 5,584,566 | A | | 12/1996 | Bowman et al. | 362/220 |

* cited by examiner

*Primary Examiner*—Anthony Knight
*Assistant Examiner*—Doug Hutton
(74) *Attorney, Agent, or Firm*—Theodore R. Harper

(57) ABSTRACT

An overhead media display system for installation of signs and display elements on a suspended ceiling and other ceiling fixtures is disclosed. The present system includes a plurality of interchangeable display structures of different geometric shapes and sizes, which are constructed from both transparent and translucent materials that function with backlighting being installed directly underneath ceiling light fixtures and, alternatively, from opaque plastic materials being attached at ceiling locations without direct illumination. Each sign or display element includes integral retaining flanges with compressive elements that are formed by the use of die-cutting, scoring, folding, and other assembly techniques during construction thereby eliminating the need for fastening hardware and adhesive materials for installation. Each sign or display element is fabricated from a single blank of material, which is imprinted, die-cut, scored, folded and assembled to provide optimal structural strength to function as a permanent store display for presentation of product advertising and commercial art, but is sufficiently versatile and inexpensive to be used for temporary sales promotions. Motion and enhanced visual interest may be imparted to the present sign system by the addition of interactive sign elements rotatably mounted on the interior and exterior of the signs. Rotational movement of the interactive sign elements is provided by a miniature electric motor powered by a photovoltaic cell array, which generates electrical voltage derived from the adjacent light fixtures.

35 Claims, 19 Drawing Sheets

OVERHEAD MEDIA DISPLAY SYSTEM

FIELD OF INVENTION

The present invention relates generally to decorative covers for lighting fixtures and, more particularly, to an overhead media display system for attachment of display structures such as product signs to suspended ceilings and ceiling mounted light fixtures.

BACKGROUND OF THE INVENTION

The competitive demand for advertising space in the retail store setting and, in particular, in convenience stores has prompted innovative sales and marketing techniques for many consumer products. In convenience stores, for instance, vendors typically make payments to the store owners in order to obtain shelf space or to get favorable product or signage placement on the ends of aisles or near the cash register. Retail store displays and advertising signs of many different configurations are utilized by vendors to direct the consumer's attention to particular products within the store.

Signs and product displays in convenience stores tend to fall into two general categories. "Point-of-presence" signs tend to be permanent in character and need to be attractive and durable. "Promotional" signs tend to be temporary in nature and must be easily installed and removed. In addition, they must be inexpensive because they are frequently changed as sales promotions come and go.

Many convenience store owners traditionally display promotional signs on store windows and glass doors to advertise current sale items and prices. Of course, the availability of window advertising space is limited and, in addition, such signs may present security concerns for the store owner by limiting visibility of the store premises and parking lot areas. Thus, there exists a need for practical alternatives to conventional "point-of-presence" and "promotional" advertising signs and product displays.

Advertising signs hanging from the ceiling of the store have good visibility and should be desirable to advertisers. However, there are many problems associated with the current art relating to such ceiling mounted signs and display elements which have prevented their commercial acceptance and widespread use. Some varieties of ceiling mounted displays are simply unattractive being nothing more than a lightweight sign suspended on a string. Others are relatively expensive to manufacture and difficult to assemble and install being comprised of numerous component parts. For example, a decorative cover bearing advertising indicia for display on ceiling mounted light fixtures of the type used in acoustical suspended ceilings is disclosed in U.S. Pat. No. 5,128,850. It will be noted that the ('850) patent requires separate fastening components such as magnetic strips, adhesive tape, or hook and grommet fasteners for securing the decorative cover to the suspended ceiling, which significantly increases the manufacturing cost and the difficulty of installation.

Further, a major consideration for any national marketing firm attempting to deliver advertising signs and product displays to thousands of convenience stores is the ability to conveniently and economically ship these items via established delivery services. Although a three-dimensional sign having multiple display surfaces would be desirable for advertising purposes, such a bulky sign structure is more expensive to package, ship, and store on the shelf A generally flat sign is less expensive to package and ship and more convenient to store.

Accordingly, the present invention has been developed to solve these problems by providing an overhead media display system, which is designed for attachment of signs and other display elements on suspended ceilings and other ceiling fixtures. Each sign or display element is constructed of a single piece of opaque or translucent plastic, which is folded, plastic welded or glued to provide structural strength, and includes integral retaining elements for affixing the sign or display element to a suspended ceiling framework or other ceiling fixture. No additional structural support members or fasteners are necessary due to the properties of the materials and the novel folding techniques incorporated in their fabrication.

After being constructed and assembled, each sign or display element can be conveniently folded to a flattened condition for shipping. The present signs and display elements are inexpensive and can easily be installed and replaced in connection with temporary sales promotions, but are sufficiently stable and attractive to serve as permanent, point-of-presence advertising and commercial art displays.

DESCRIPTION OF PRIOR ART

One example of a prior art sign is disclosed in U.S. Pat. No. 5,128,850 to Uosis Juodvalkis, which shows a decorative cover for a ceiling mounted light comprising a translucent decorative sheet or film attached to the ceiling such that the light source is located above the cover providing backlighting for the decorative design. It will be noted that this patent discloses a V-shaped translucent cover limited to use with a light source directly above the cover. The V-shaped configuration, wherein planar panels 22 and 24 extend from the merge line 26 comprising a so-called "living hinge", results in a relatively unstable construction, which must be supported by strengthening strips 42 and 44, or by end caps 46 and 48 in an alternative embodiment. The cover is preferably attached to the suspended ceiling framework by magnetic means such as magnetic strips, or by other conventional fasteners such as hooks and grommets, Velcro fasteners, or other adhesives, which increase manufacturing and installation costs.

Another example of a prior art sign is disclosed in U.S. Pat. No. 4,716,671 to Jan S. Gross, which shows a decorative advertising cover for overhead fluorescent strip lighting having the general shape of a triangular prism. This cover has several components namely a transparent plastic sheet 11 joined by two end caps 10 to form the triangular prism shape. A preferred material for the end caps 10 is an injection moldable, fire-retardant ABS resin. The transparent polyester sheet 11 is preferably thermoformed into its final V-shape as shown in FIG. 8 before being adhesively fixed to end caps 10.

Another prior art sign is disclosed in U.S. Pat. No. 4,856,216 to Jan S. Gross, which shows an advertising cover for overhead fluorescent strip lighting similar in overall construction to the ('671) patent to Gross. This cover further includes modified end caps 30 providing for sliding engagement of the cover with the lighting fixture and additional frame components 32 and 33 defining channel recesses 42 to receive interchangeable plastic sheets with advertising printed thereon.

Still another example of a prior art sign is disclosed in U.S. Pat. No. 5,282,331 to Michael J. Fell, which illustrates a display module for attachment to suspended ceiling framing members adjacent a lighting fixture. The module 1 is comprised of a trough 10 made of light transmissive material comprising face panels 15 and 16 and separate triangular end closures 20 and 21. The module 1 is provided with optional upper and lower panel supports 31 and 32 and an interchangeable panel 8. Flanges 22, 23, and 11 extend outwardly from the top edges of the end closures 20 and 21 and serve as the attachment areas for securing the module to the ceiling frame members by use of a plurality of universal clips 12 as shown in FIG. 1.

Another prior art sign is disclosed in U.S. Pat. No. 5,584,566 to William K. Bowman, which shows a backlighting light fixture adapted for use in providing backlight illumination for display structures having a framework made of rail members assembled to define openings with translucent image bearing panels mounted in the openings.

Another example of a prior art sign is disclosed in U.S. Pat. No. 5,025,355 to Ronald P. Harwood, which describes a combination lighting fixture and graphic display means for suspension from a ceiling having a concealed raceway for wiring and lighting transformers while at the same time providing illuminated display panels to which graphics may be applied.

Still another prior art sign is disclosed in U.S. Pat. No. 5,154,014 to A. David Groy et al., which shows a dynamic reflective image display apparatus designed to visually enhance a two-dimensional sign. This device comprises a linear housing adapted to receive a stationary tubular light positioned in front of a stationary reflective panel of parabolic configuration. A multi-colored translucent tubular sleeve is radially disposed about the light tube and rotated such that a multi-colored light is emitted through transparent characters in a front panel of the apparatus to catch the eye of passersby who will hopefully read the message.

Yet another example of a prior art sign is disclosed in U.S. Pat. No. 5,355,604 to Roy M. Rathke, which shows a sign utilizing ambient illumination for displaying information. Light transmitting side panels and separate side walls are arranged in a triangular prism configuration that provides a top opening for the entry between the panels of light emitted from fluorescent tubes in a ceiling mounted light fixture. A manually-operated reel having a spindle, on which a web similar to a household window shade is wound, displays printed information to consumers.

Finally, another example of a prior art sign is disclosed in U.S. Pat. No. 569,764 to Charles L. Nason, which describes an illuminated sign comprising a transparent cylinder adapted for revolving mechanical movement within a housing. The required signs are cut into the revolving cylinder containing incandescent light sources and multi-colored strips. By reason of the changing character of the light caused by the revolving cylinder and the differently colored strips, the character of the sign is continually changed.

SUMMARY OF THE INVENTION

Accordingly, the present invention is an overhead media display system for attachment to the supporting frame of suspended ceilings and other ceiling mounted fixtures. The present system includes a plurality of interchangeable signs or display elements of different geometric shapes and sizes, which are constructed from both translucent and/or transparent materials that function both with backlighting being installed directly underneath ceiling light fixtures and, alternatively, from opaque plastic materials being attached at ceiling locations without direct illumination.

Advantageously, retaining elements for securing the signs to the framework of suspended ceilings and other similar fixtures are integrally formed in each sign by the use of novel folding and plastic welding techniques during construction thereby eliminating the need for fastening clips, magnetic strips, hook and grommet fasteners, Velcro fasteners, or adhesive tapes required in prior art devices. This feature simplifies the installation and/or replacement of the signs and significantly reduces manufacturing costs thereof.

Each sign or display element of the present system is fabricated from a single sheet of a foldable, plastic material or other material having mechanical properties suitable for this purpose. So constructed, the signs of the present invention require no additional structural supporting members because their structural stability is obtained through the mechanical properties of the selected materials and the novel folding, plastic welding, and assembly techniques disclosed in accordance with this invention. Each sign or design element is die-cut, scored, folded, plastic welded, and assembled to provide geometric configurations of sufficient structural strength to serve as a point-of-presence display for advertising and commercial art, but is sufficiently versatile and inexpensive to be used for temporary sales promotions.

Another significant advantage of the present invention is that after each sign or display element is completely constructed and assembled, it may be conveniently folded into a flattened condition to facilitate shipping and storage.

In addition, the present invention provides optional interactive display elements that operation in conjunction with the geometrically-shaped signs to impart motion and visual interest to the overhead media display to attract the attention of consumers.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures wherein:

DETAILED DESCRIPTION OF THE PREFERRED EMBODIMENTS

Figure 1:
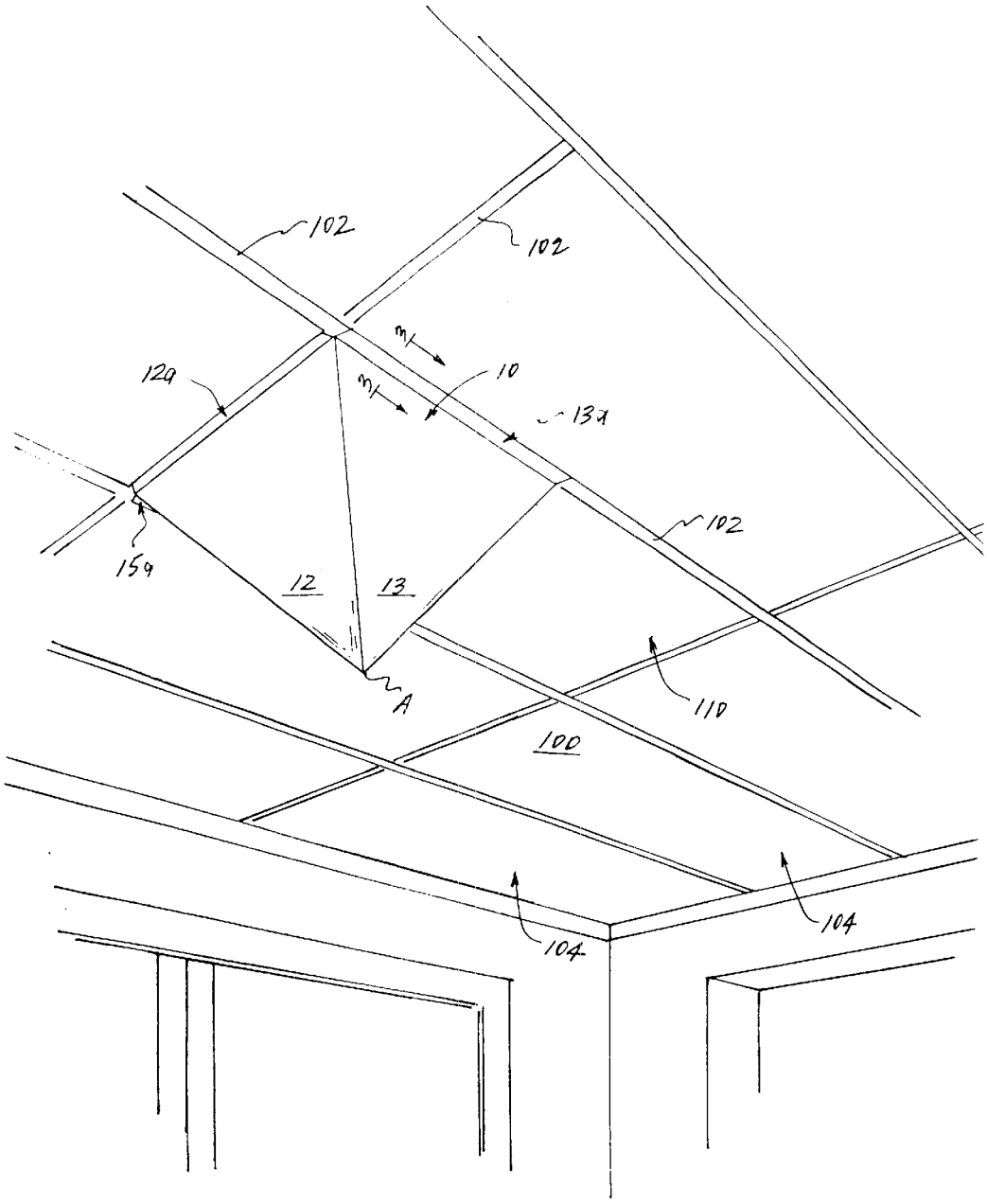
FIG. 1 is a perspective view of an embodiment of a pyramidical sign or display element in accordance with the present system disposed beneath a lighting fixture within a suspended ceiling.

With further reference to the drawings there is shown therein an embodiment of a sign or display element in accordance with the present invention, indicated generally at 10, and mounted directly beneath an overhead lighting fixture, indicated generally at 110, within a suspended ceiling 100.

The suspended ceiling 100 is comprised of a framework of regularly spaced, generally T-shaped supporting members 102, which create ceiling tile and light fixture receiving areas in a known manner. Positioned in the respective areas are ceiling tiles 104 and the light fixture 110. Generally, the receiving areas within the ceiling 100 will have an axial length dimension of four feet and an axial width dimension of two feet. In some ceiling installations the axial dimensions are equal. However, the dimensions of the receiving areas are generally the subject of standardized building codes and/or are dictated by commercially available ceiling tile and light fixture sizes.

In the preferred embodiment the sign or display element 10 is constructed from a single sheet of foldable, plastic material, preferably with thickness in the approximate range of 0.010–0.015 inches, for imparting structural stability to the geometric sign configuration. The material must also have physical and mechanical properties suitable for die-cutting, scoring, folding, and properties appropriate for the particular assembly technique and application chosen for the sign or display element such as gluing, welding, punching, embossing, ink compatibility, gloss/matte finish, flame resistance, tear resistance, etc. These selective properties are determined by the manufacturing and decorative processes to be performed on the sign 10, and a material is selected to meet the requirements. Plastic sheet materials produced under the trademarks TRANSVY and TRANSALLOY P-300/P-260 and supplied by Transilwrap Company, Inc., Chicago, Ill. have proven to be suitable for this application. Of course, numerous other types of foldable sheet materials may be suitable for specific applications.

The plastic sheet materials may be either transparent, translucent, or opaque depending upon the type of lighting to be utilized for a given application. That is if backlighting is used to illuminate the indicia, printed graphics, or other artistic designs displayed on the sign 10, a transparent or translucent light transmissive material is used. In the alternative, if the sign 10 is to be illuminated indirectly by ambient light, an opaque material may be more desirable.

In the embodiment shown in FIG. 1, the sign or display element 10 is a pyramidical configuration comprised of four triangular side panels 12–15 converging at an apex point A and defining an open base portion (not shown), which is disposed upwardly and adjacent the plane of the ceiling 100. Two of the side panels, namely 13 and 15 respectively are provided with integral retaining flanges, indicated generally at 13*a* and 15*a*, including compressive retaining elements integrally formed therein. The retaining flanges 13*a* and 15*a* function to attach the sign 10 to the ceiling support members 102 or other ceiling fixtures during an installation procedure of the present media display system as described hereinafter in further detail. The remaining side panels, namely 12 and 14, are provided with stabilizing flanges, indicated generally at 12*a* and 14*a*, which serve to impart rigidity and structural stability to the sign 10 after to installation.

Figure 2:
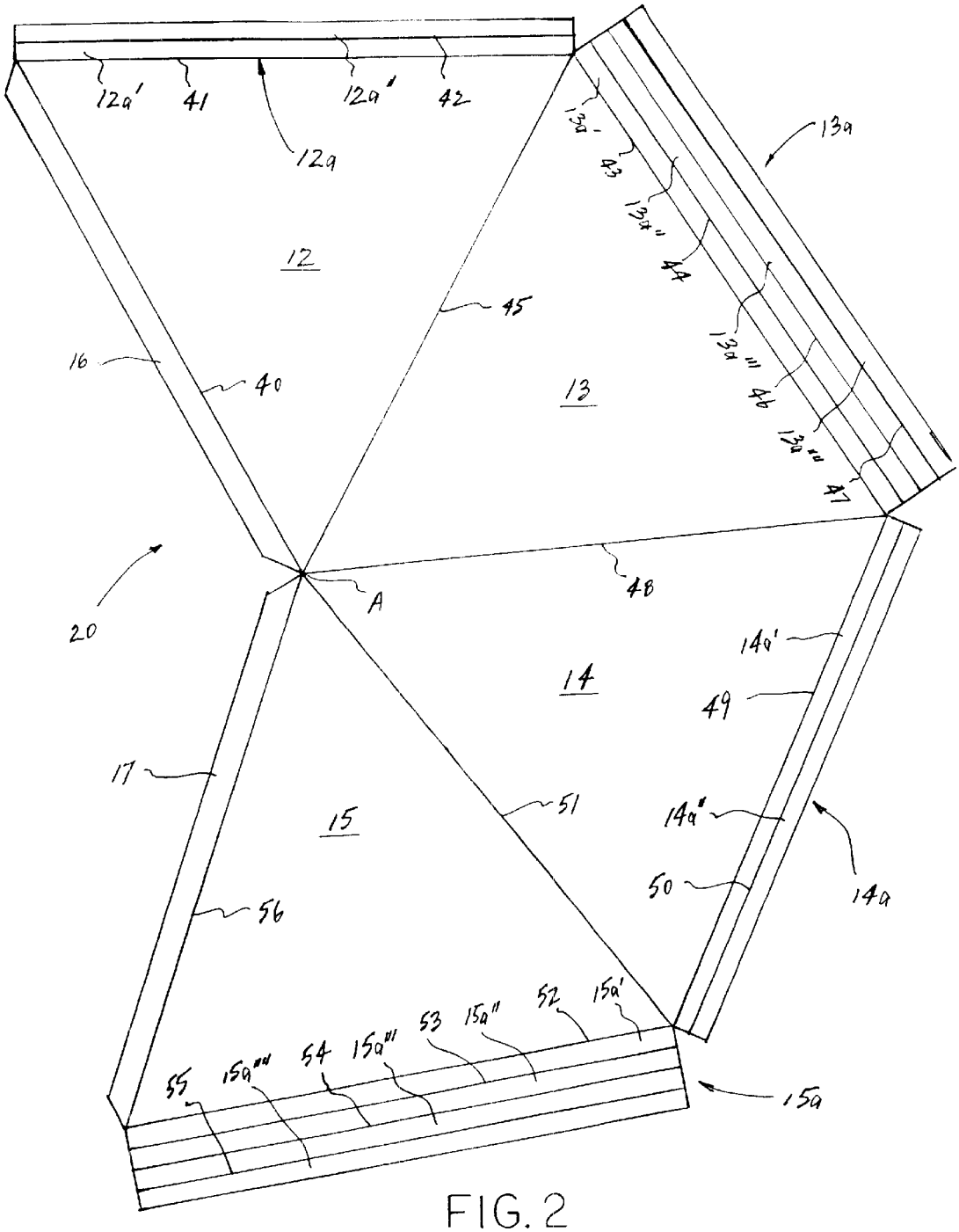
FIG. 2 is a top plan view of a material blank that is utilized to construct the pyramidical sign of FIG. 1.

Referring now to FIG. 2, the construction of the sign or display element 10 will be described in detail. Initially, the imprinting of advertising indicia, graphics, embossing, and other commercial art designs will be applied to blank sheets of the plastic material selected for the sign's construction. Such decorative processes may be accomplished by any number of industrial and/or artistic techniques including printing, painting, silk screening, embossing, stamping, air brushing, punching, etc. known in the art.

As previously indicated the sign or design element 10 is constructed from a single sheet or blank, indicated generally at 20, of a foldable, plastic material. Initially, the blank 20 is die-cut to a predetermined outline and dimensions, which are calculated to provide the finished configuration and the proper fit to the ceiling tile and light fixture receiving areas as in the suspended ceiling 100 or to fit other light fixtures whereon the sign 10 is to be installed. This is accomplished in a die-cutting press with tooling set up to fabricate the blank 20. Simultaneously, the die-cutting press scores the desired fold lines on the blank 20 as seen in FIG. 2 and hereinafter described.

Since such die-cutting processes are well known to those skilled in the art, further detailed discussion of the same is not deemed necessary.

The blank 20 includes structures providing a means for retaining the sign or display element to the suspended ceiling 100. Such structures integrally form for example, retaining means including but not limited to those hereinafter described.

The blank 20 comprises at one end thereof the triangular side panel 12. A first leg (delineated by fold line 40) of the triangular side panel 12 is integrally connected to an adjacent longitudinal edge portion of a weld tab 16 along fold line 40 where the blank is folded 90 degrees and pivotally connects the side panel 12 to the weld tab 16.

The adjacent base leg (delineated by fold line 41) of the triangular side panel 12 is integrally connected to an adjacent longitudinal edge portion of a lower horizontal surface 12*a*' of the flange 12*a* along fold line 41 where the blank 20 is folded 90 degrees and pivotally connects the side panel 12 thereto. The opposing longitudinal edge portion of lower horizontal surface 12*a*' is integrally connected to an adjacent longitudinal edge portion of an upper horizontal surface 12*a*" along the fold line 42 where the blank 20 is folded 180 degrees onto surface 12*a*' and pivotally connects thereto. The surfaces 12*a*' and 12*a*" are welded or glued in face-to-face relation to form the stabilizing flange 12*a*.

A second leg (delineated by fold line 45) of the triangular side panel 12 is integrally connected to an adjacent first leg (also delineated by fold line 45) of the triangular side panel 13 along fold line 45 where the blank 20 is folded 90 degrees and pivotally connects thereto.

The adjacent base leg (delineated by fold line 43) of the side panel 13 is integrally connected to an adjacent longitudinal edge portion of a lower horizontal surface 13*a*' of the flange 13*a* along the fold line 43 where the blank is folded 90 degrees and pivotally connects the side panel 13 thereto. The opposing longitudinal edge portion of lower horizontal surface 13*a*' is integrally connected to an adjacent longitudinal edge portion of an upper horizontal surface 13*a*" of the flange 13*a* along the fold line 44 where the blank 20 is folded 180 degrees onto surface 13*a*'.

The opposing longitudinal edge portion of upper horizontal surface 13*a*" is integrally connected to an adjacent longitudinal edge portion of an upper retaining element 13*a*'" along the fold line 46 where the blank 20 is folded 180 degrees onto surface 13*a*" and pivotally connects thereto. The opposing longitudinal edge portion of upper retaining surface 13*a*'" is integrally connected to an adjacent longitudinal edge portion of a lower retaining element 13*a*"" along the fold line 47 where the blank 20 is folded 180 degrees onto the surface 12*a*'" and pivotally connects thereto.

Figure 3:
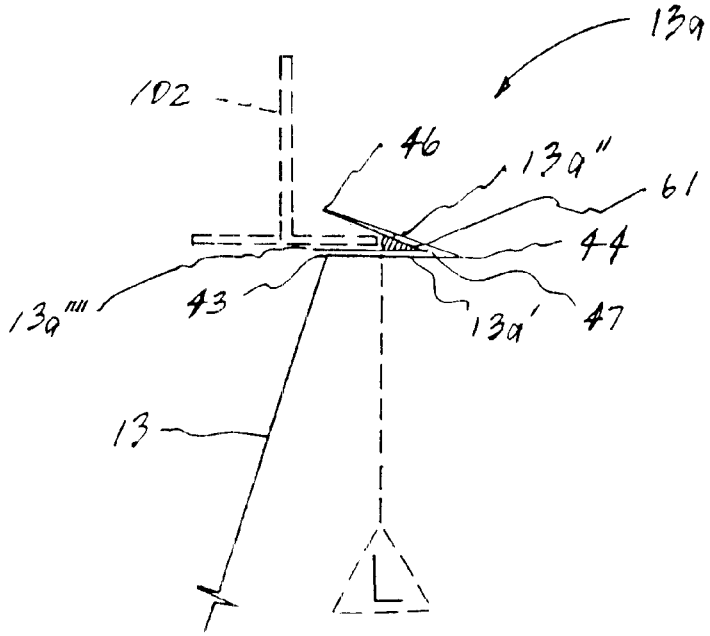
FIG. 3 is a cross-sectional view of a retaining flange taken along section line 3—3 of the sign of FIG. 1 showing the folded surfaces comprising the retaining flange.

When the folding sequence described above for the flange 13*a* is completed, the component surfaces 13*a*' and 13*a*" together with the compressive retaining elements 13*a*'" and 13*a*"" are arranged as shown in FIG. 3. Next, the juxtaposed surfaces 13*a*' and 13*a*"" are plastic welded or joined by adhesives. Similarly, the juxtaposed surfaces 13*a*" and 13*a*'" are plastic welded or glued together.

Thereafter, an additional bead of adhesive or plastic weld 61 is applied along the fold line 47 between the retaining elements 13*a*'" and 13*a*"" to strengthen the clamping force of the flange 13*a* and to effectively shift the load bearing point of the flange 13*a* from a point corresponding to the axis of fold line 47 inwardly to the approximate midpoint of the surface 13*a* to prevent the flange from slipping off the cross-member 102 under the weight or load (i.e. depicted by the load L in FIG. 3), which is created by the sign 10 after installation.

In this manner a retaining flange 13*a* is formed along the entire length of the base leg of the side panel 13 for engagement with the cross-members 102 as shown in FIG. 3, which form the periphery of the ceiling tile and light fixture receiving areas in the suspended ceiling 100.

However, it will noted that the formation of a retaining flange such as flange 13*a* along the entire length of a structural feature such as side panel 13 is not necessary in some configurations for adequate support of the sign or display element 10. In such instances it may be desirable to provide linear interruptions or gaps (not shown) in the retaining flanges to provide for the flow of air and/or added artistic effect to the sign 10.

Referring again to FIG. 2, a second leg (delineated by fold line 48) of the triangular side panel 13 is integrally connected to the adjacent first leg (also delineated by fold line 48) of the triangular side panel 14 along fold line 48 where the blank is folded 90 degrees and pivotally connects thereto.

The adjacent base leg (delineated by fold line 49) of the side panel 14 is integrally connected to an adjacent longitudinal edge portion of a lower horizontal surface 14*a*' of the stabilizing flange 14*a* along the fold line 49 where the blank is folded 90 degrees and pivotally connects the side panel 14 thereto. The opposing longitudinal edge portion of lower horizontal surface 14*a*' is integrally connected to an adjacent longitudinal edge portion of an upper horizontal surface 14*a*" along the fold line 50 where the blank 20 is folded 180 degrees onto surface 14*a*' and pivotally connects thereto. The surfaces 14*a*' and 14*a*" are plastic welded or glued in face-to-face relation to form the stabilizing flange 14*a*.

A second leg (delineated by fold line 51) of the side panel 14 is integrally connected to the adjacent first leg (also delineated by fold line 51 ) of the triangular side panel 15 along fold line 51 where the blank 20 is folded 90 degrees and pivotally attaches thereto.

The adjacent base leg (delineated by the fold line 52) of the side panel 15 is integrally connected to an adjacent longitudinal edge portion of a lower horizontal surface 15*a*' of the retaining flange 15*a* along fold line 52 where the blank is folded 90 degrees and pivotally connects the side panel 15 thereto. The opposing longitudinal edge portion of lower horizontal surface 15*a*' is integrally connected to an adjacent longitudinal edge portion of an upper horizontal surface 15*a*" of the flange 15*a* along the fold line 53 where the blank is folded 180 degrees onto surface 15*a*'.

The opposing longitudinal edge portion of upper horizontal surface 15*a*" is integrally connected to an adjacent longitudinal edge portion of an upper retaining element 15*a*'" along the fold line 54 where the blank 20 is folded 180 degrees onto surface 15*a*" and pivotally connects thereto. The opposing longitudinal edge portion of upper retaining element 15*a*'" is integrally connected to an adjacent longitudinal edge portion of a lower retaining element 15*a*"" along fold line 55 where the blank 20 is folded 180 degrees onto the surface 15*a*'" and pivotally attaches thereto.

Figure 4:
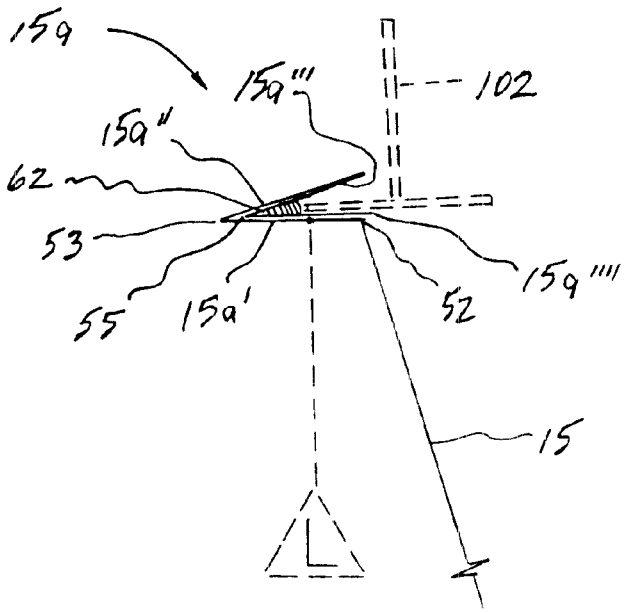
FIG. 4 is a cross-sectional view taken through a retaining flange formed in the sign of FIG. 1 and disposed opposite the retaining flange of FIG. 3 being a mirror image thereof.
Figure 5A:
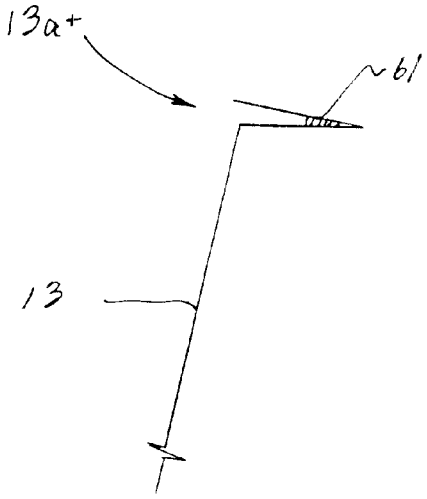
FIGS. 5A through 5D are a series of cross-sectional views of alternative embodiments of the retaining flange illustrated in FIG. 3 showing alternative folding techniques therefor.
Figure 5B:
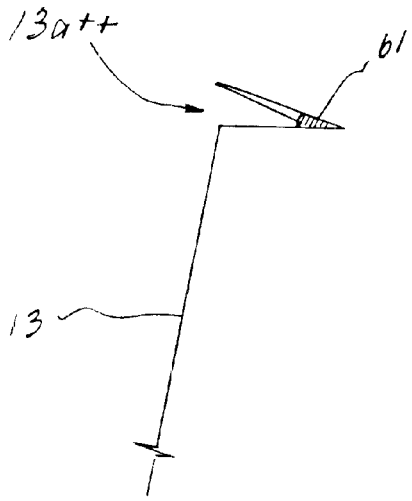
Figure 5C:
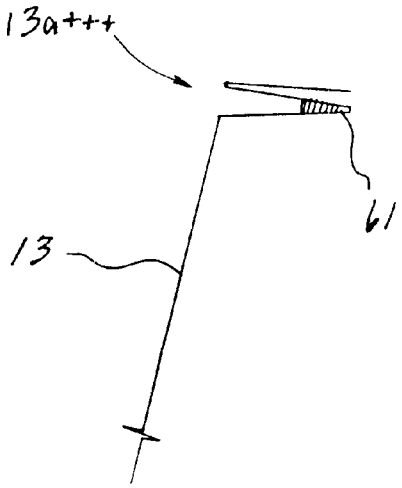
Figure 5D:
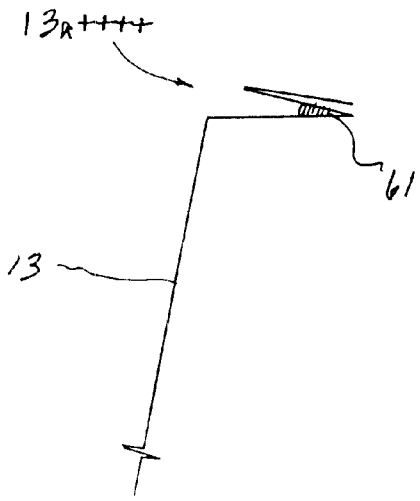

When the folding sequence described hereinabove for the flange 15*a* is completed, the component surfaces 15*a*' and 15*a*" together with the retaining elements 15*a*'" and 15*a*"" are arranged as shown in FIG. 4. Next, the juxtaposed surfaces 15*a*' and 15*a*'" are joined by adhesives or plastic welding. Similarly, the juxtaposed surfaces 15*a*" and 15*a*'" are plastic welded or glued together.

Thereafter, an additional bead of adhesive or plastic weld 62 is applied along the fold line 55 and between the retaining elements 15*a*'" and 15*a*"" to strengthen the clamping force of the flange 15*a* and to effectively shift the load bearing point of the flange 15*a* from a point corresponding to the axis of fold line 53 inwardly to the approximate midpoint of surface 15*a*'. This novel construction is designed to prevent the flange from slipping of the cross-member 102 under the weight or load (i. e. depicted by the load L in FIG. 4), which is generated by the sign 10 after installation.

In this manner the retaining flange 15*a* is formed opposite the retaining flange 13*a* for engagement of the respective cross-members 102 as shown in FIG. 4 defining the periphery of the ceiling tile and light fixture receiving areas in the suspended ceiling 100.

Still referring to FIG. 2, a second leg (delineated by the fold line 56) of the triangular side panel 15 is integrally connected to an adjacent longitudinal edge portion of a weld tab 17 along fold line 56 where the blank 20 is folded 90 degrees and pivotally connects the side panel 15 to the weld tab 17.

Finally, the weld tabs 16 and 17 are drawn together in overlapping relation and the juxtaposed surfaces thereof are joined by adhesives or plastic welding to complete the pyramidical configuration of the sign 10.

It will be appreciated by those skilled in the art that various alternative folding techniques may be utilized to construct the retaining flanges 13*a* and 15*a* for a given application of the sign or display element 10, which are designated 13*a*+ to 13*a*++++ respectively, and illustrated diagrammatically in FIGS. 5A–5D. Such alternative folding techniques for the flanges 13*a* and 15*a* are determined by the material selected for construction and its physical properties, the thickness of the material, the size of the sign, etc. Thus, the folding techniques described hereinabove for constructing the retaining flanges 13*a* and 15*a* are intended to be illustrative of the present invention and not restrictive in any sense.

In an installation procedure for the present media display system, the installer simply positions either retaining flange 13*a* or 15*a* on the selected cross-member 102 defining the receiving area in the suspended ceiling 100 wherein the sign 10 is to be located. After either retaining flange 13*a* or 15*a* is engaged with a cross-member 102 as shown in FIGS. 3 and 4, the opposite retaining flange is drawn over the opposing cross-member 102 in similar fashion to complete the installation. Because the sign 10 has been fabricated to predetermined dimensions corresponding to the dimensions of ceiling tile and light fixture receiving areas, no additional fastening hardware or adhesive elements are required to secure the sign 10 to the ceiling.

Figure 6:
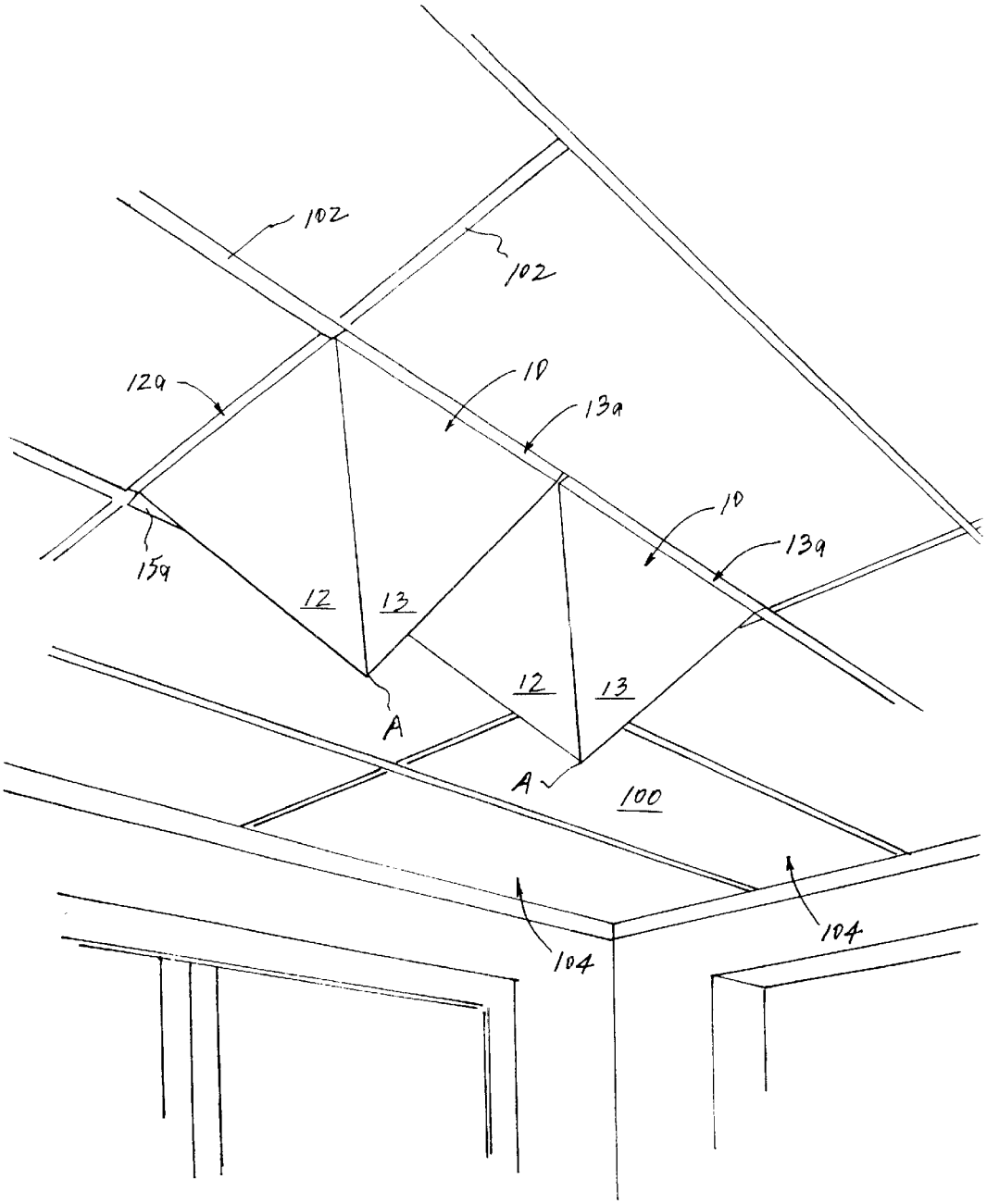
FIG. 6 is a perspective view of a pair of the pyramidical signs of FIG. 1 mounted in an array beneath a light fixture within a suspended ceiling.

Referring now to FIG. 6, it will be understood that two or more signs or display elements 10 may be installed in an array extending across the length of the lighting fixture 110 on the parallel cross-members 102 when backlighting is used to illuminate the display elements. Further, it will be understood that an array of signs 10 may extend to any number of ceiling tile and light fixture receiving areas, separately or in combination, utilizing backlighting and/or ambient light as desired along the gridwork of cross-members 102 in the suspended ceiling 100.

Figure 6A:
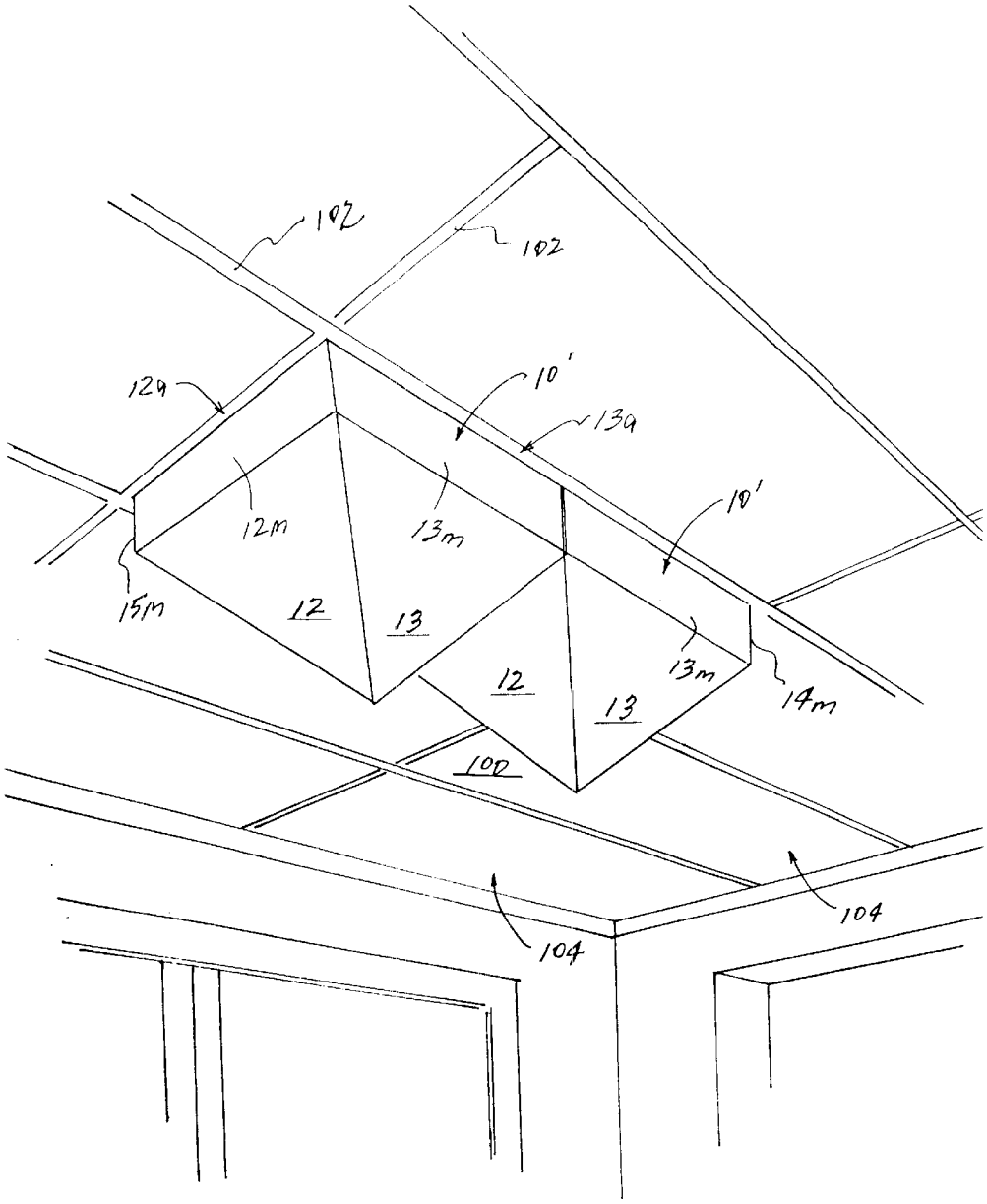
FIG. 6A is a perspective view of a pair of the pyramidical signs of FIG. 1 modified to include integral rectangular surfaces adjacent the triangular side panels.
Figure 6B:
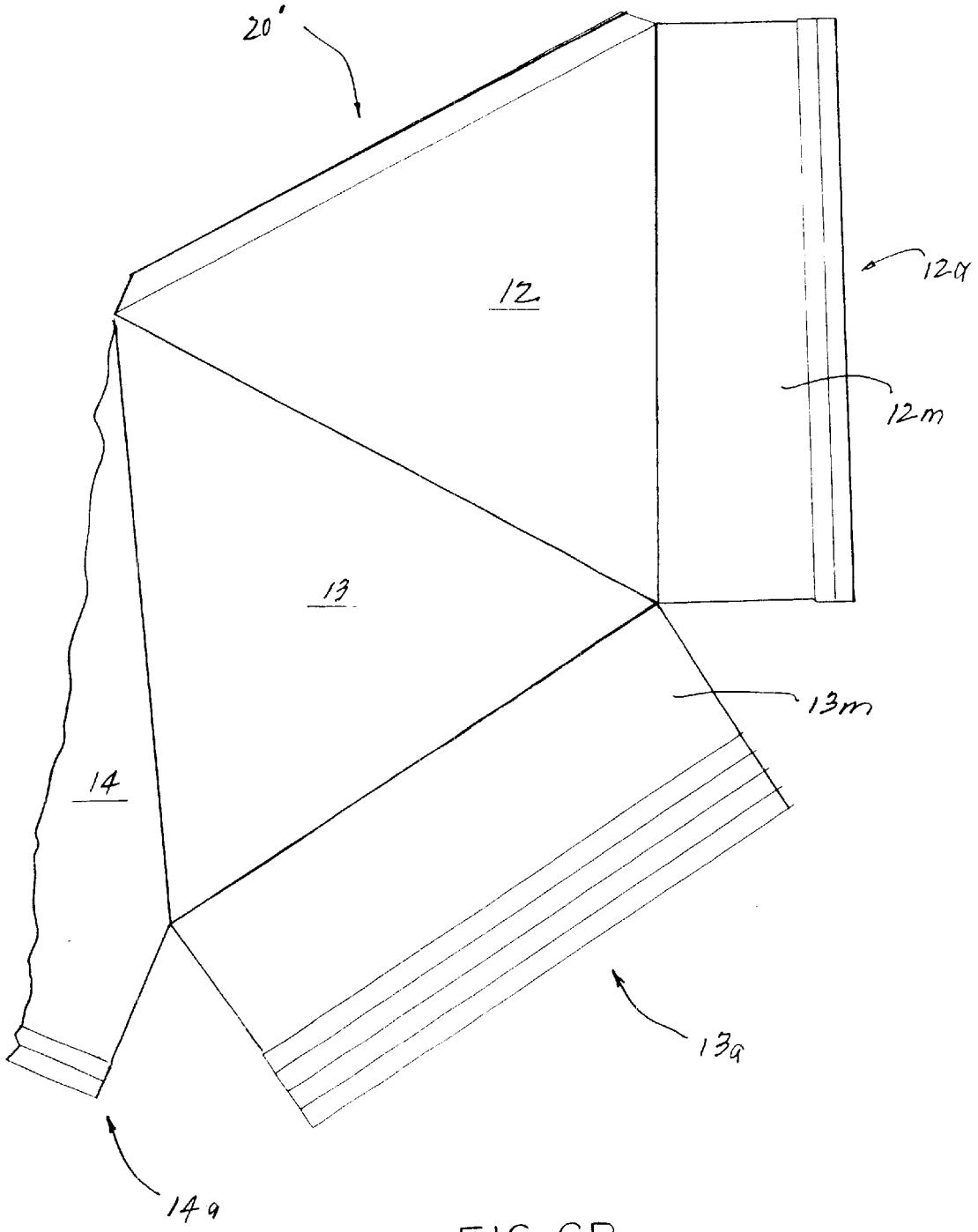
FIG. 6B is a partial top plan view showing a portion of a modified material blank utilized to construct the modified signs of FIG. 6A.

Further, it will be appreciated by those skilled in the art that the number of available display surfaces and the total available surface area on a sign or display element may be increased by simple dimensional changes and minor modifications to the blank 20. For example, FIG. 6A illustrates a pair of modified signs 10' wherein the blank has been modified as shown in FIG. 6B to include additional rectangular display panels 12*m*–15*m*, which have been integrally connected between each of the side panels 12–15 and their respective flanges 12*a*–15*a* along the fold lines 41, 43, 49, and 52.

Figure 6C:
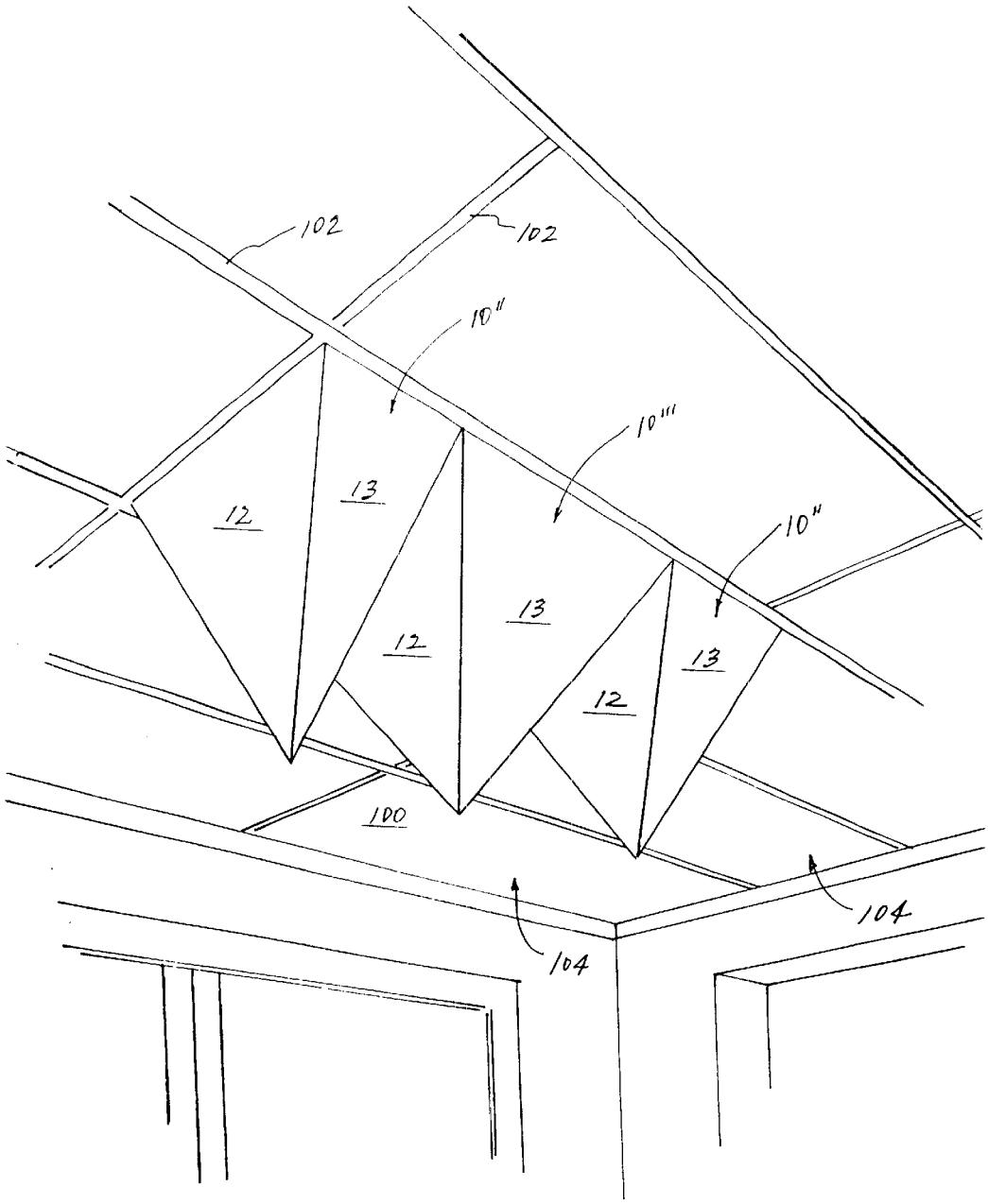
FIG. 6C is a perspective view of an array of the pyramidical signs of FIG. 1 wherein the linear dimensions and included angles of the triangular side panels have been modified to produce elongated pyramidical shapes.

In another variation of the pyramidical sign 10, the linear dimensions and included angles in each of the side panels 12–15 have been varied using trigonometric calculations to produce the elongated pyramidical signs 10" and 10'" illustrated in FIG. 6C.

Figure 7:
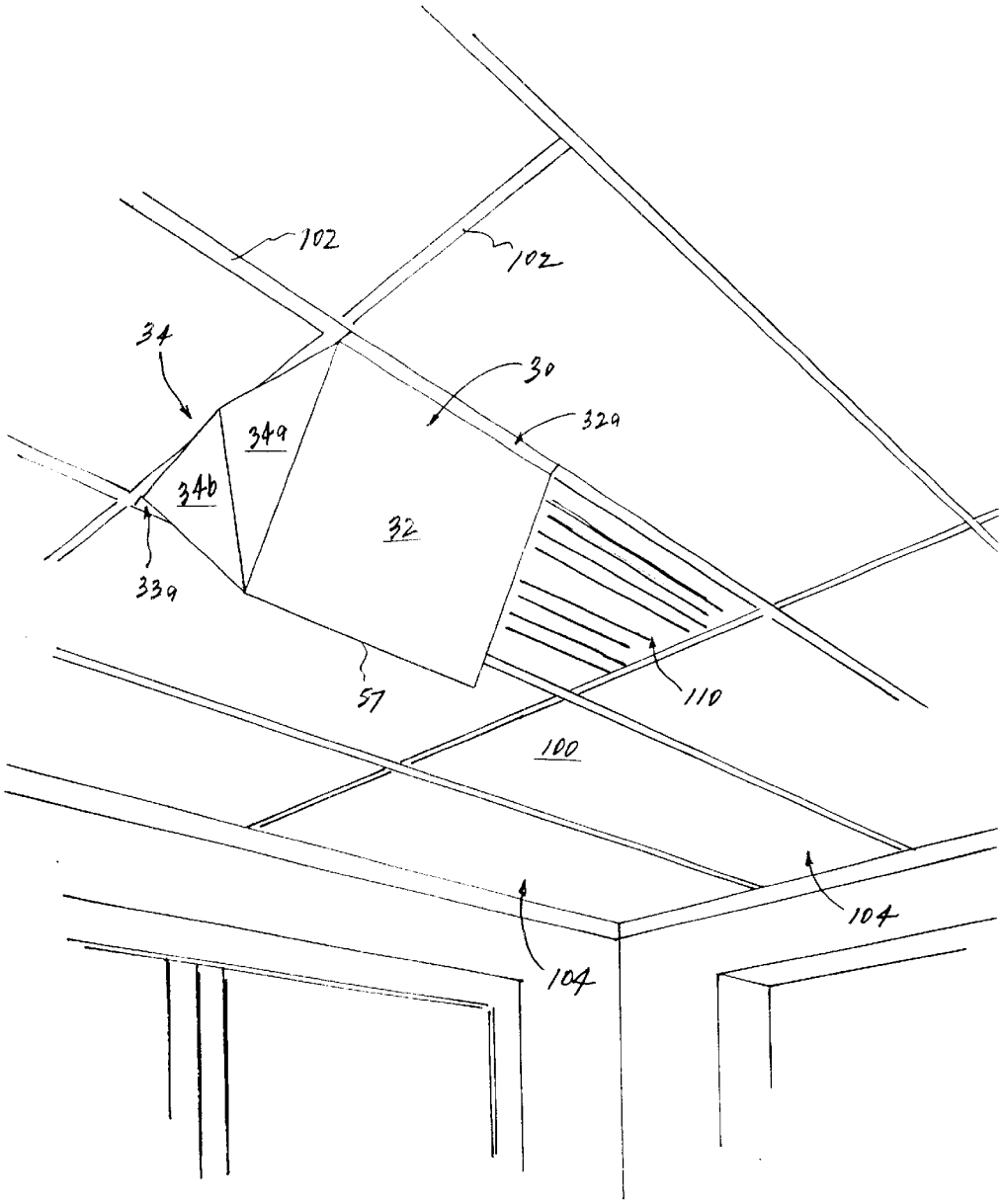
FIG. 7 is a perspective view of an alternative embodiment of a triangular prism-shaped sign or display element mounted beneath a lighting fixture within a suspended ceiling.

Referring to FIG. 7, there is shown therein an alternative embodiment of a sign or design element in accordance with the present media display system, indicated generally at 30. In this embodiment the sign 30 is shaped as a triangular prism comprised of two generally rectangular side panels 32 and 33 extending downwardly and inwardly so as to merge at the fold line 57 such that the sign 30 defines a V-shaped configuration This triangular prism sign 30 also includes an open base portion (not shown), which is disposed upwardly and adjacent the plane of the ceiling. The two side panels 32 and 33 respectively are provided with integral retaining flanges, indicated generally at 32*a* and 33*a*, including compressive retaining elements formed therein substantially identical to the retaining flanges 13*a* and 15*a* described hereinabove. The retaining flanges 32*a* and 33*a* also function to attach the sign 30 to the ceiling cross-members 102 in substantially the same manner. The triangular end panels, indicated generally at 34 and 35 respectively are provided with reinforcing flanges which serve to impart rigidity and structural stability to the sign 30 after installation.

Figure 8:
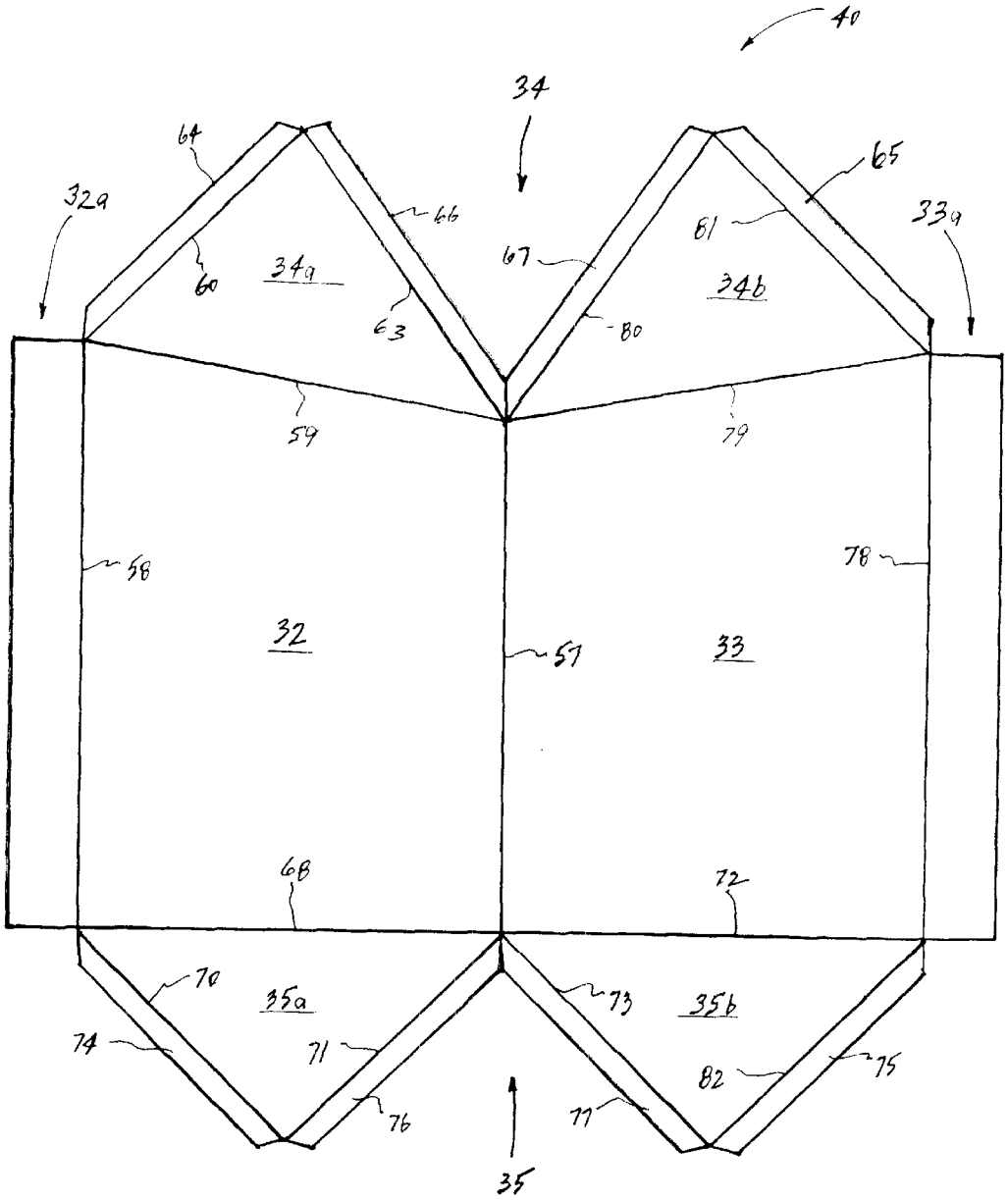
FIG. 8 is a top plan view of a material blank that is utilized to construct the triangular prism-shaped sign of FIG. 7.

The sign or design element 30 is also constructed from a single sheet or blank, indicated generally at 40, of a foldable, plastic material as shown in FIG. 8. Initially the blank 40 is die-cut to predetermined dimensions, which are calculated to provide the finished configuration and proper fit to the ceiling tile and light fixture receiving areas in the suspended ceiling 100. This is accomplished in a die-cutting press with tooling set up to fabricate the blank 40 as seen in FIG. 8 and hereinafter described.

The blank 40 includes at one side thereof the generally rectangular or polygonal side panel 32. A first longitudinal edge portion (delineated by the fold line 58) of the side panel 32 is integrally connected to an adjacent longitudinal edge portion of the retaining flange 32*a* along the fold line 58 where the blank is folded and pivotally connects the side panel 32 thereto.

It will be understood that the retaining flange 32*a* is constructed in the substantially the same manner described hereinabove for the retaining flange 13*a* illustrated in FIG. 3, and the folding sequence and assembly instructions will not be repeated here to relieve prolixity in this disclosure.

The adjacent side edge of panel 32 (delineated by fold line 59) is integrally connected to an adjacent base leg (also delineated by the fold line 59) of the triangular end cap half-section 34*a* where the blank is folded 90 degrees and pivotally connects thereto. An adjacent first leg (delineated by the fold line 60) of the end cap half-section 34*a* is integrally connected to an adjacent longitudinal edge portion of a reinforcing flange 64 where the blank 30 is folded 180 degrees onto the section 34*a* and secured by adhesive or plastic welding.

A second leg (delineated by the fold line 63) of the triangular section 34*a* is integrally connected to an adjacent longitudinal edge portion of a weld tab 66 along fold line 63 where the blank is folded 90 degrees and pivotally connects the section 34*a* to the weld tab 66.

An opposite side edge of the side panel 32 (delineated by the fold line 68) is integrally connected to an adjacent base leg (also delineated by the fold line 68) of the triangular end cap half-section 35*a* where the blank is folded 90 degrees and pivotally connects thereto. An adjacent first leg (delineated by the fold line 70) of the end cap half-section 35*a* is integrally connected to an adjacent longitudinal edge portion of a reinforcing flange 74 where the blank is folded 180 degrees onto the section 35*a* and secured by adhesive or plastic welding.

A second leg (delineated by the fold line 71) of the triangular section 35*a* is integrally connected to an adjacent longitudinal edge portion of weld tab 76 along fold line 71 where the blank is folded 90 degrees and pivotally connects the section 35*a* to the weld tab 76.

The blank 40 includes at an opposite side thereof the generally rectangular or polygonal side panel 33 which is integrally connected to the side panel 32 along the fold line 57 where the blank 40 is folded to the approximate angle shown in FIG. 7. A first longitudinal edge portion (delineated by the fold line 78) of the side panel 33 is integrally connected to an adjacent longitudinal edge portion of the retaining flange 33*a* along the fold line 78 where the blank is folded and pivotally connects the side panel 33 thereto.

It will be understood that the retaining flange 33*a* is constructed in substantially the same manner described hereinabove for the retaining flange 15*a* illustrated in FIG. 4, and the folding sequence and assembly instructions will not be repeated here to relieve prolixity in this disclosure.

The adjacent side edge of panel 33 (delineated by the fold line 79) is integrally connected to an adjacent base leg (also delineated by the fold line 79) of the triangular end cap half-section 34*b* where the blank is folded 90 degrees and pivotally connects thereto. An adjacent first leg (delineated by the fold line 80) of the end cap half-section 34*b* is integrally connected to an adjacent longitudinal edge portion of a weld tab 67 along fold line 80 where the blank is folded 90 degrees and pivotally connects the section 34*b* to the weld tab 67.

A second leg (delineated by the fold line 81) of the triangular section 34*b* is integrally connected to an adjacent longitudinal edge portion of a reinforcing flange 65 where the blank is folded 180 degrees onto the section 34*b* and secured by adhesive or plastic welding.

An opposite side edge of the side panel 33 (delineated by the fold line 72) is integrally connected to an adjacent base leg (also delineated by the fold line 72) of the triangular end cap half-section 35*b* where the blank is folded 90 degrees and pivotally connects thereto. An adjacent first leg (delineated by the fold line 73) of the end cap half-section 35*b* is integrally connected to an adjacent longitudinal edge portion of weld tab 77 along fold line 73 where the blank is folded 90 degrees and pivotally connects the section 35*b* to the weld tab 77.

A second leg (delineated by the fold line 82) of the triangular section 35*b* is integrally connected to an adjacent longitudinal edge portion of a reinforcing flange 75 along fold line 82 where the blank is folded 180 degrees onto the section 35*b* and secured by adhesive or plastic welding.

Finally, the weld tabs 66 and 67 are drawn together in overlapping relation and the contacting surfaces thereof are joined by adhesive or plastic welding. Similarly, the weld tabs 76 and 77 are drawn together in overlapping relation and the contacting surfaces thereof are secured by adhesive or plastic welding to complete the assembly of this triangular prism sign 30.

It will be understood that the various alternative folding techniques described hereinabove in the construction of the retaining flanges 13*a* and 15*a* and illustrated in FIGS. 5A to 5D also apply to the retaining flanges 32*a* and 33*a* of sign 30.

The installation procedure for this alternative embodiment is also essentially the same as described hereinabove in relation to sign 10 with the exception of the reinforcing flanges 64–65 and 74–75 which are utilized in lieu of stabilizing flanges 12*a* and 14*a*. It will also be noted that the side edges (delineated by fold lines 59 and 79) of the respective side panels 32 and 33 are not parallel to the opposed side edges (delineated by the fold lines 68 and 72) thereof This design variation produces an end panel 34 which protrudes outwardly at a predetermined angle to create a more visible and aesthetically interesting display surface on the sign 30.

Figure 9:
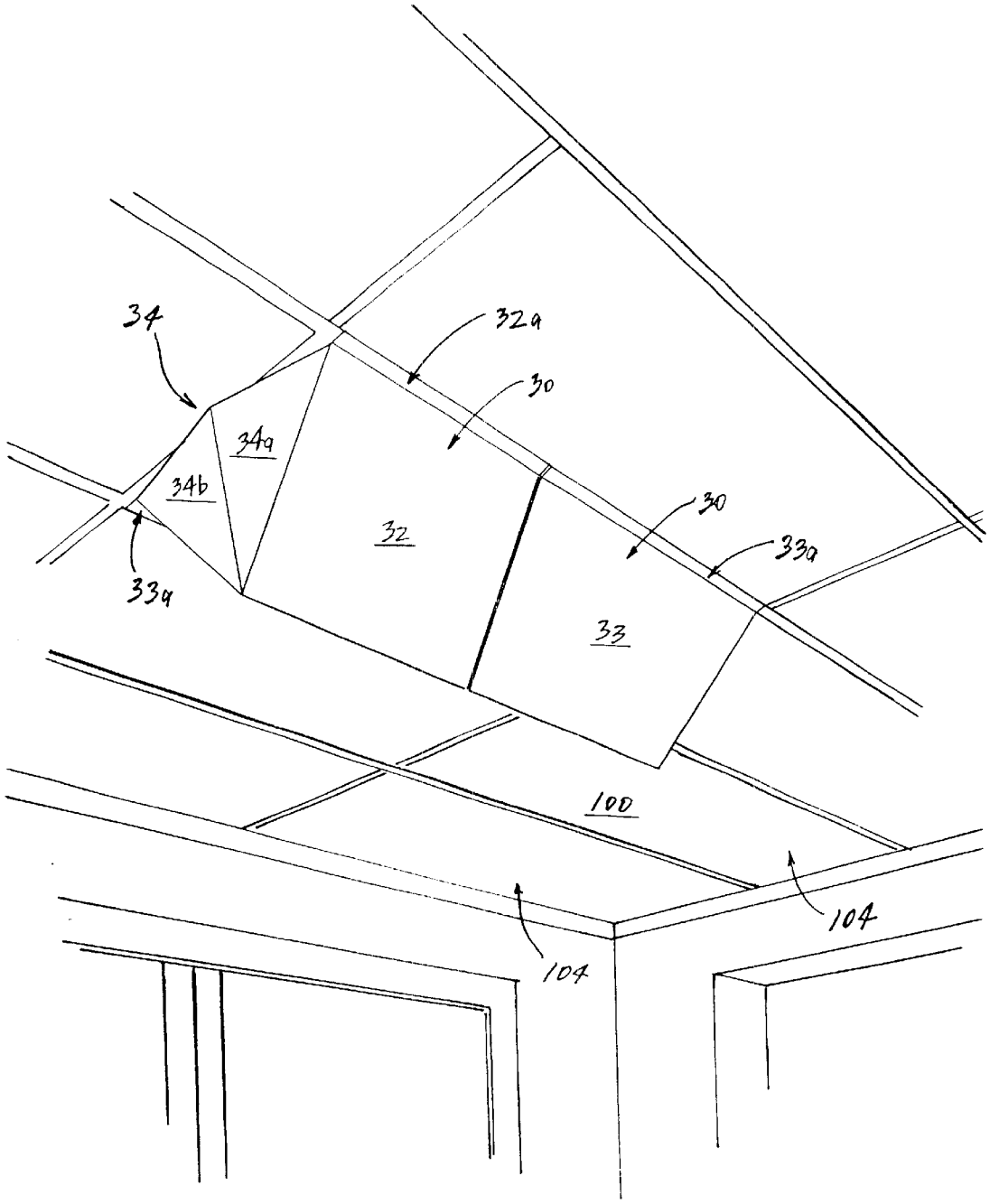
FIG. 9 is a perspective view of a pair of the triangular prism-shaped signs of FIG. 7 mounted in an array beneath a light fixture within a suspended ceiling.

Referring now to FIG. 9, it will be seen that the sign or design element 30 also lends itself to installation in pairs extending across the length of the lighting fixture 110 on the parallel cross-members 102 when backlighting is to be used to illuminate the display elements or, alternatively, mounted within ceiling tile receiving areas when ambient light is utilized.

Figure 9A:
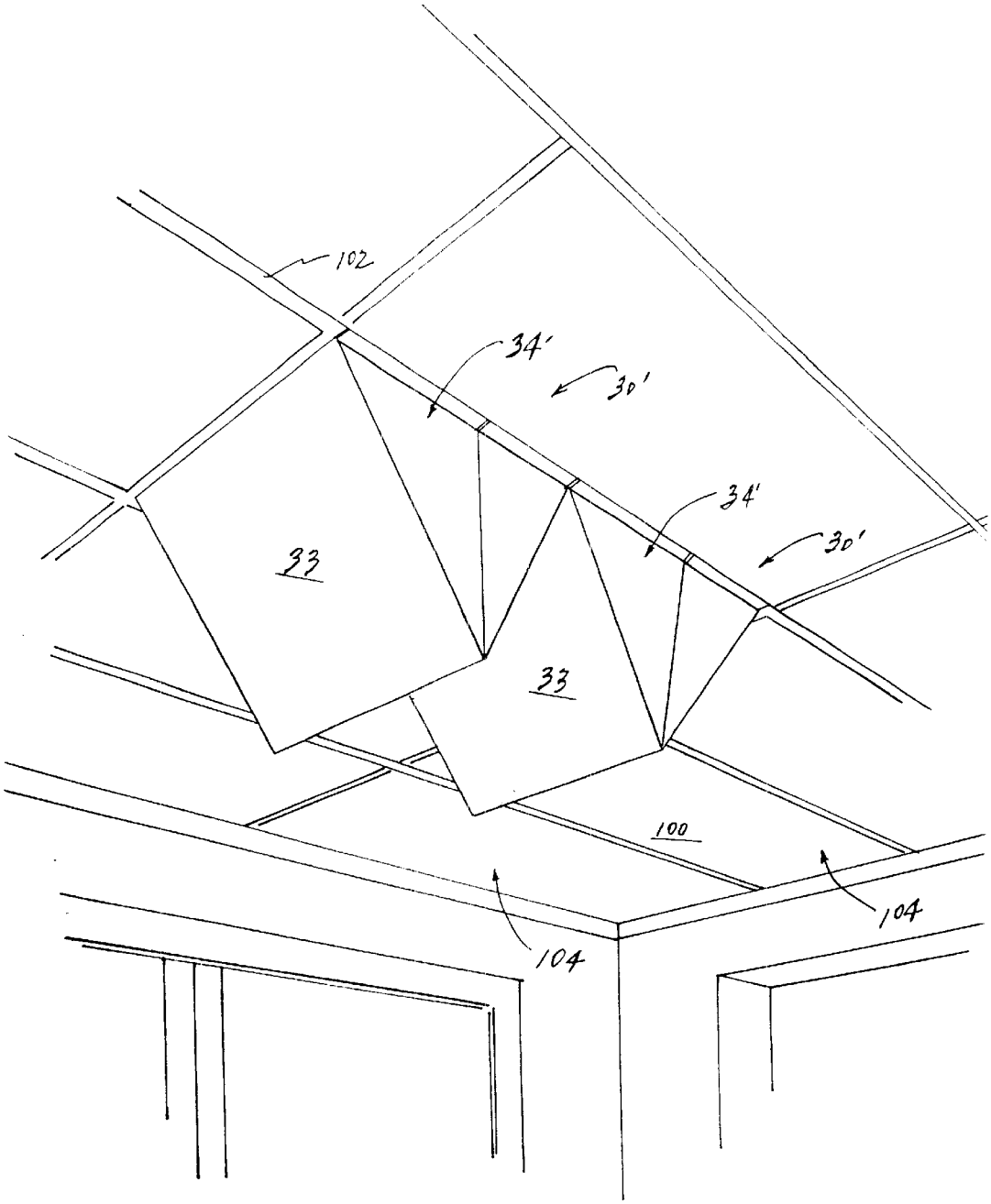
FIG. 9A is a perspective view of a pair of modified triangular prism-shaped signs wherein the orientation of the sign and the integral retaining flanges formed therein has been rotated 90 degrees relative to the signs of FIG. 9.
Figure 9B:
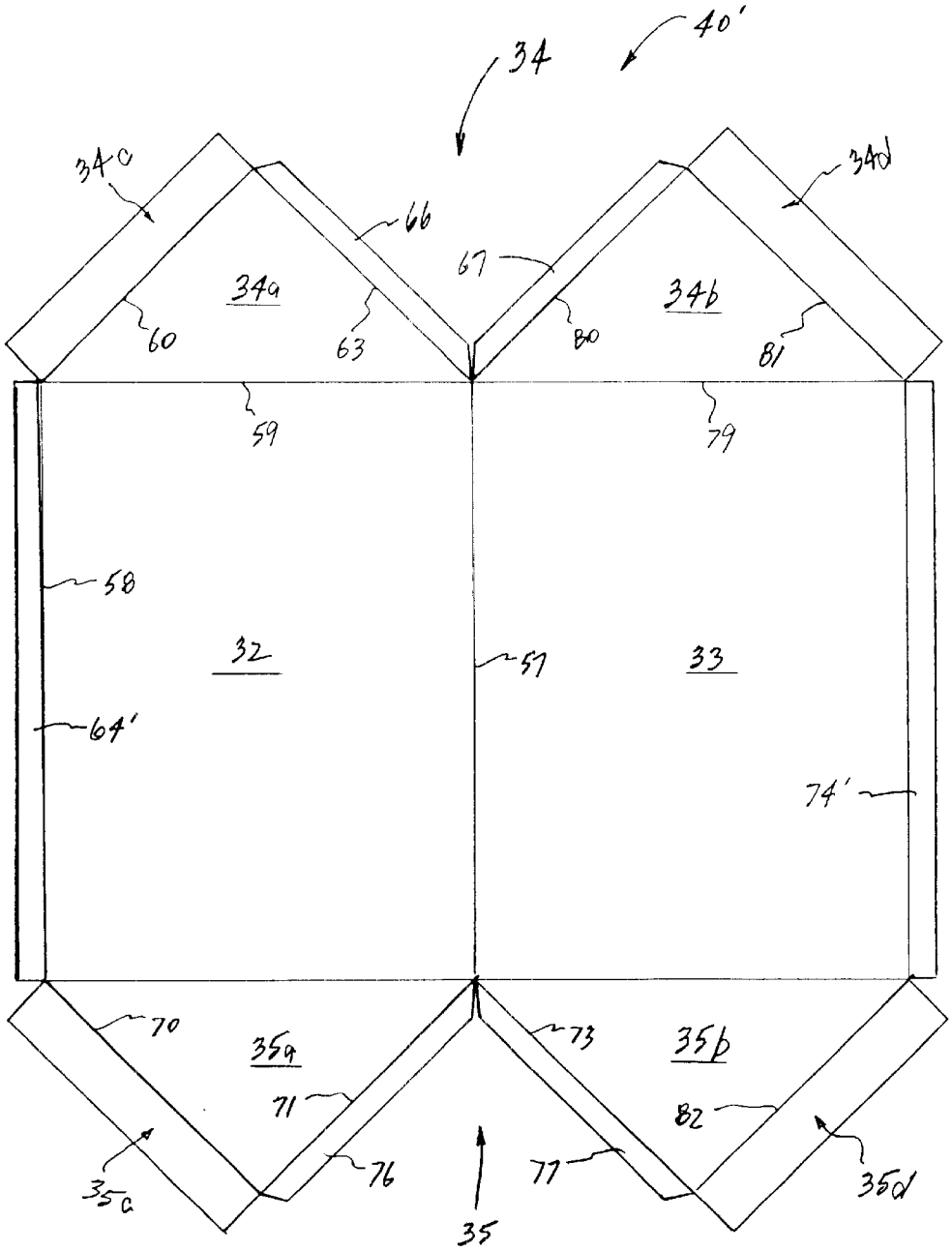
FIG. 9B is a top plan view of a material blank that is utilized to construct the modified triangular prism-shaped signs of FIG. 9A.

FIG. 9A illustrates a pair of modified signs 30' wherein the blank 40 has been modified to the blank 40' as shown in FIG. 9B to change the axial orientation of the triangular prism-shaped sign rotating the axes of the signs 90 degrees from the positions shown in FIG. 9. This configuration requires that the retaining flanges 32*a* and 33*a* as seen in FIG. 8 be divided in two sections at each end (designated 34*c*, 34*d* and 33*c*, 35*d*) and integrally attached to the end caps 34 and 35 in place of the reinforcing flanges 64, 65 and 74, 75. Accordingly, the reinforcing flanges 64, 65 and 74, 75 as seen in FIG. 8 are lengthened (designated 64' and 74') and integrally connected to the side panels 32 and 33 along fold lines 58 and 78 as seen in FIG. 9B. Also the fold lines 59 and 79 are reoriented into parallel relation with the fold lines 68 and 72 to reorient the end cap 34 into parallel relation to the end cap 35 and to the adjacent cross-member 102 for installation.

Figure 10:
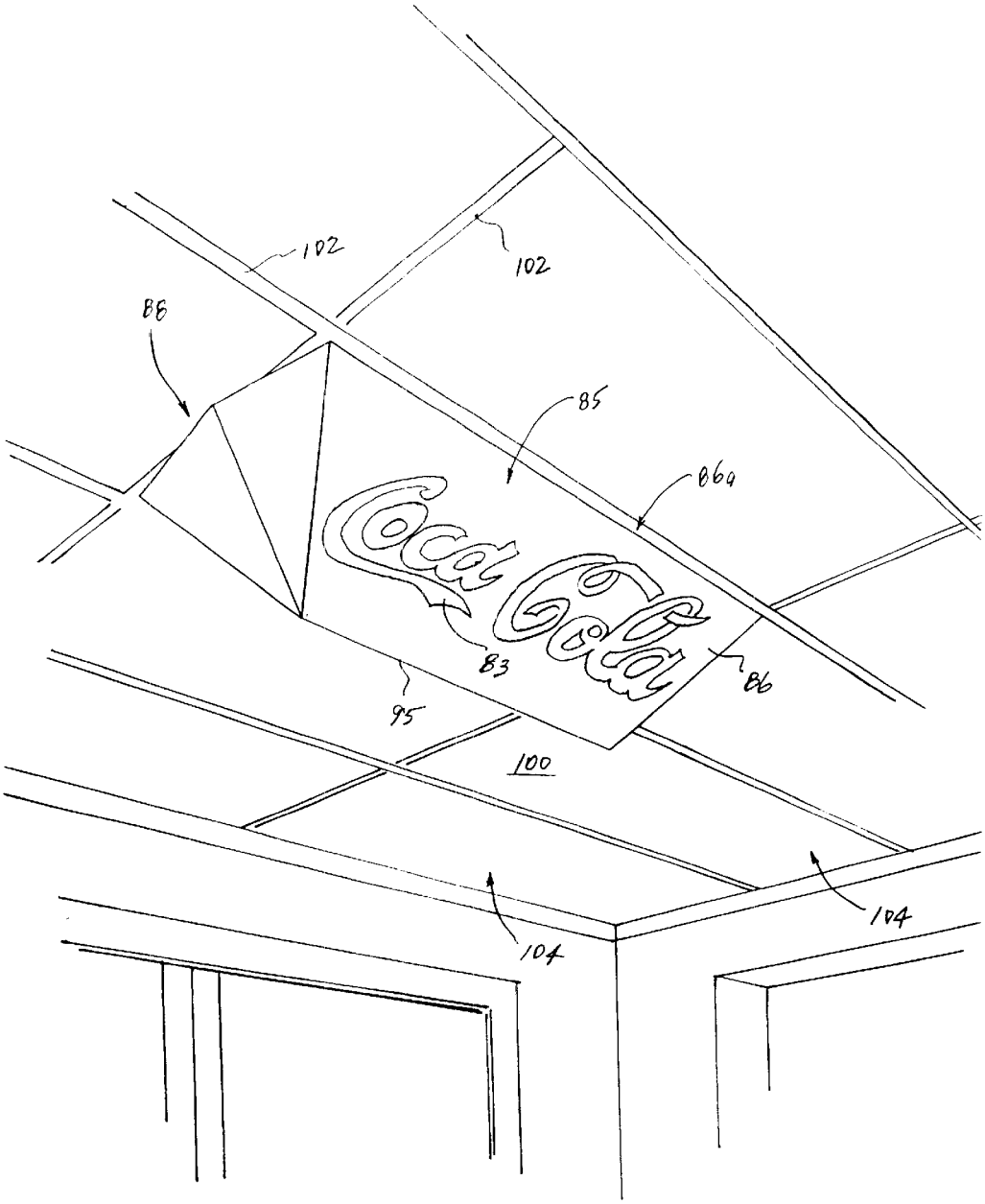
FIG. 10 is a perspective view of an alternative embodiment of a triangular prism-shaped sign mounted beneath a light fixture within a suspended ceiling.

Referring to FIG. 10, there is shown therein another alternative embodiment of a sign or design element in accordance with the present system, indicated generally at 85. In this embodiment the sign 85 is also shaped as a triangular prism comprised of two generally rectangular or polygonal side panels 86 and 87 extending downwardly and inwardly so as to merge along the fold line 95 such that the sign 85 defines a V-shaped configuration. The sign 85 bears the brand name of a soft drink product depicted in stylized indicia 83 for illustration purposes. This triangular prism-shaped sign 85 also includes an open base portion (not shown), which is disposed upwardly and adjacent the plane of the ceiling.

The side panels 86 and 87 respectively are provided with integral retaining flanges, indicated generally at 86*a* and 87*a* including compressive retaining elements formed therein substantially identical to the retaining flanges 13*a* and 15*a* described hereinabove and illustrated in FIGS. 3 and 4. The retaining flanges 86*a* and 87*a* also function to attach the sign 85 to the ceiling cross-members 102 in substantially the same manner. The triangular end panels, indicated generally at 88 and 89 respectively, are provided with reinforcing flanges which also serve to impart rigidity and structural stability to the sign 85 after installation.

Figure 11:
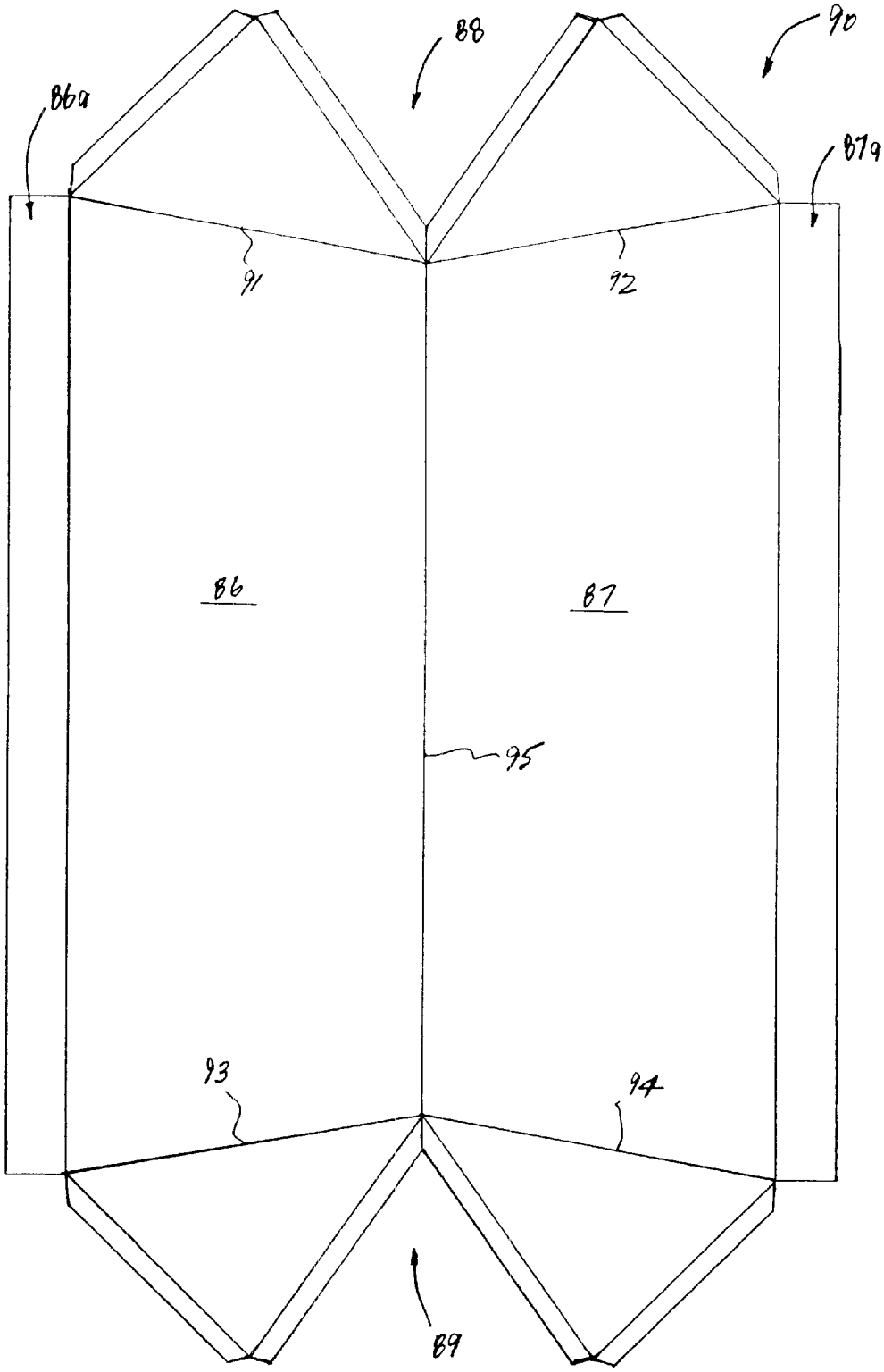
FIG. 11 is a top plan view of a material blank that is utilized to construct the triangular prism-shaped sign of FIG. 10.

The sign 85 is also constructed from a single sheet or blank, indicated generally at 90, of a foldable, plastic material as shown in FIG. 11. It will be understood that the folding sequences and assembly steps performed during the construction of the sign 85 from the blank 90 are substantially identical to those described hereinabove for the construction of the sign 30 and will not be repeated here to relieve prolixity in this disclosure.

It will also be understood that the various alternative folding techniques described hereinabove in the construction of the retaining flanges 13*a* and 15*a* and illustrated in FIGS. 5A to 5D also apply to the retaining flanges 86*a* and 87*a* of the sign 85.

The installation procedure for this alternative embodiment is also essentially the same as described hereinabove in relation to sign 30. In FIG. 11 it will be noted that the side edges (delineated by the fold lines 91 and 93) of the panel 86 and the side edges (delineated by the fold lines 92 and 94) of the panel 87 are not parallel. This design variation produces end panels 88 and 89, which protrude outwardly at a predetermined angle to create more visible end panels and an aesthetically balanced sign 85.

Figure 12:
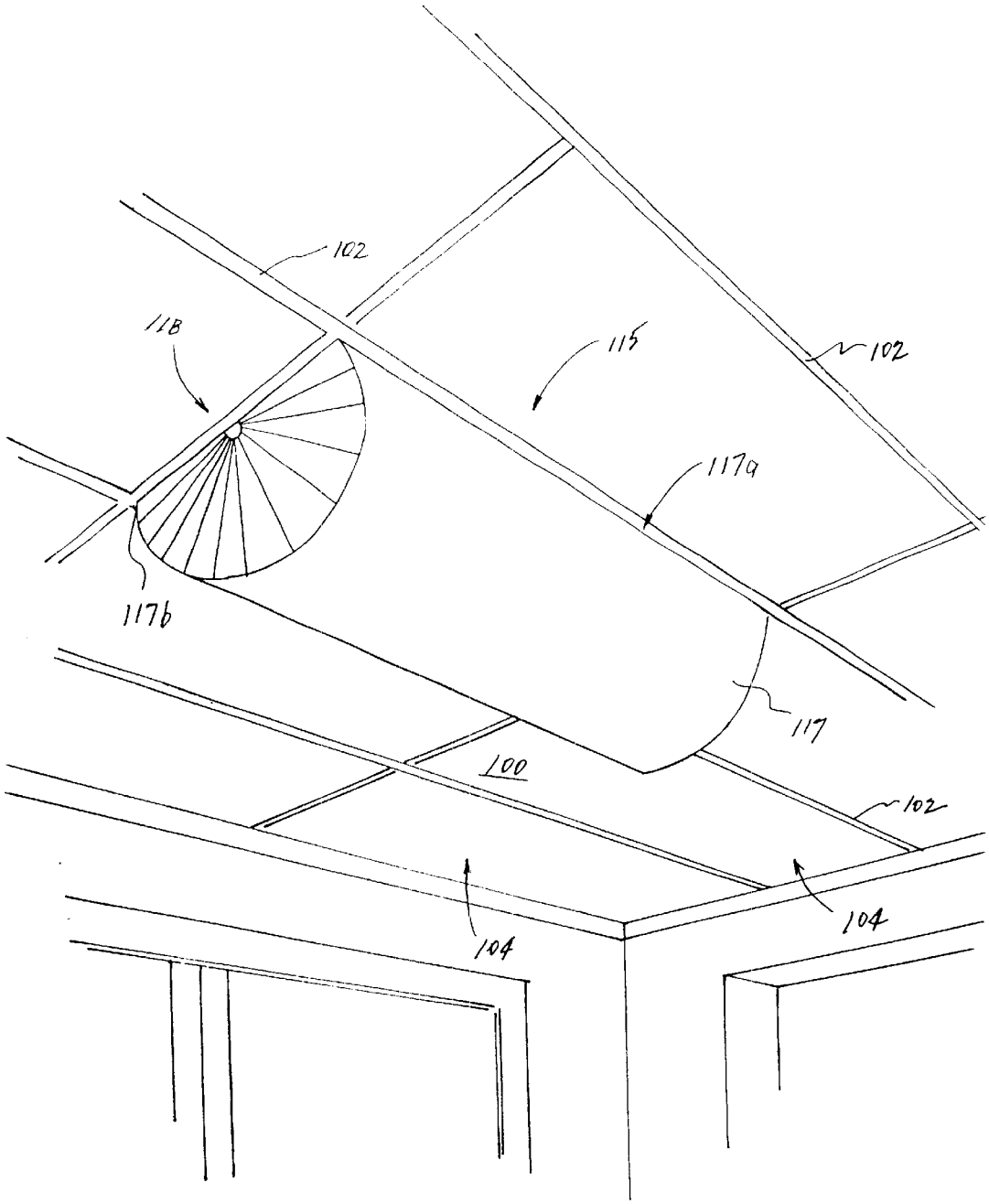
FIG. 12 is a perspective view of an alternative embodiment of a semicylindrical sign or display element mounted beneath a light fixture within a suspended ceiling.

Referring to FIG. 12 there is shown therein yet another alternative embodiment of a sign or design element in accordance with the present system, indicated generally at 115. In this embodiment the sign 115 is a semicylindrical configuration comprised of a curved display surface 117 extending downwardly and outwardly whereon advertising indicia or graphic designs may be displayed. The semicylindrical sign 115 also includes an open base portion (not shown), which is disposed upwardly and adjacent the plane of the ceiling 100. The display surface 117 is provided with integral retaining flanges, indicated generally at 117*a* and 117*b*, including compressive retaining elements formed therein substantially identical to the retaining flanges 13*a* and 15*a* described hereinabove. The retaining flanges 117*a* and 117*b* also function to attach the sign 15 to the ceiling cross-members 102 in substantially the same manner. The semicircular end panels, indicated generally at 118 and 119, serve to impart rigidity and structural stability to the sign 115 after installation.

Figure 13:
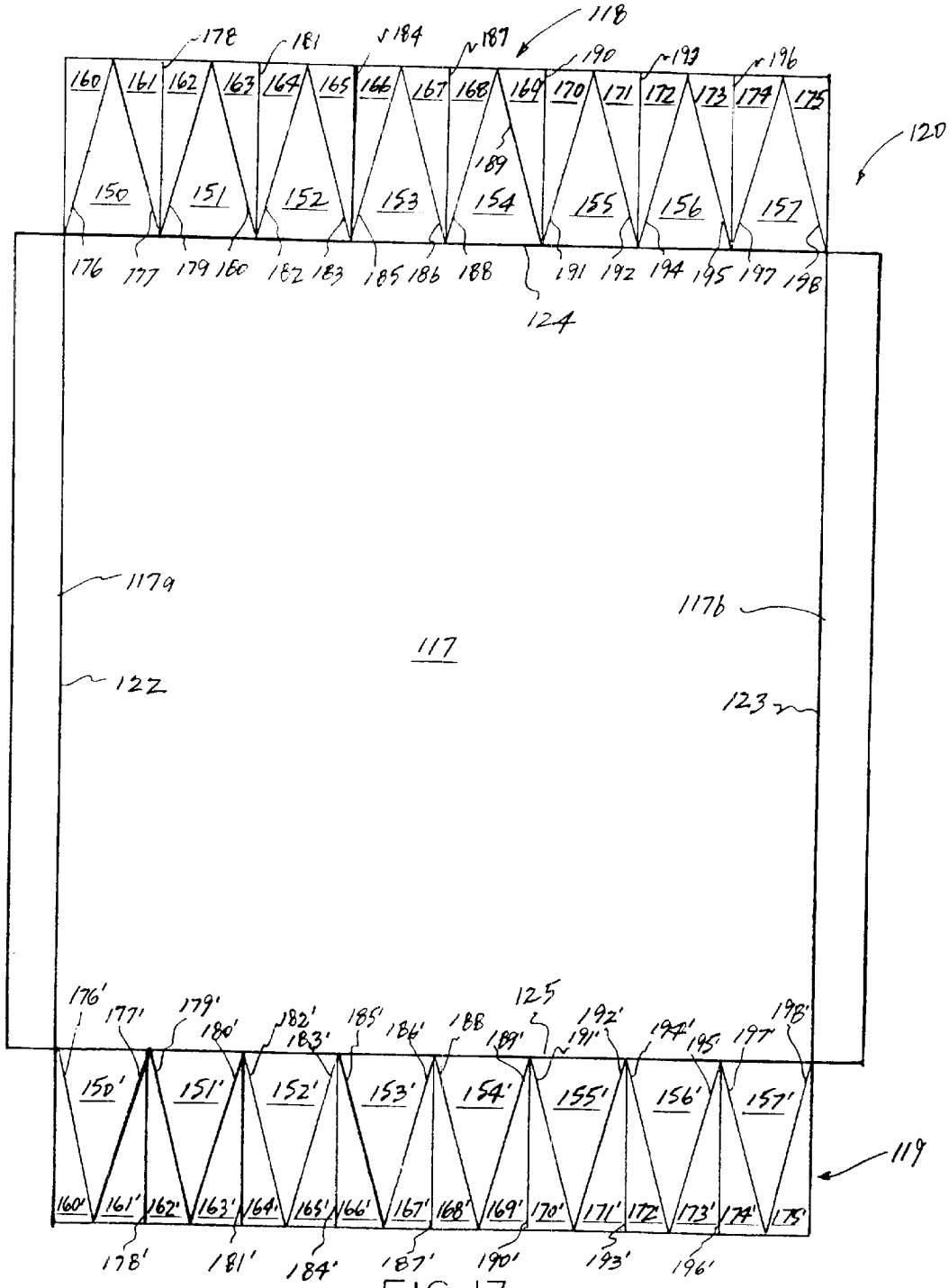
FIG. 13 is a top plan view of a material blank that is utilized to construct the semicylindrical sign of FIG. 12.
Figure 14:
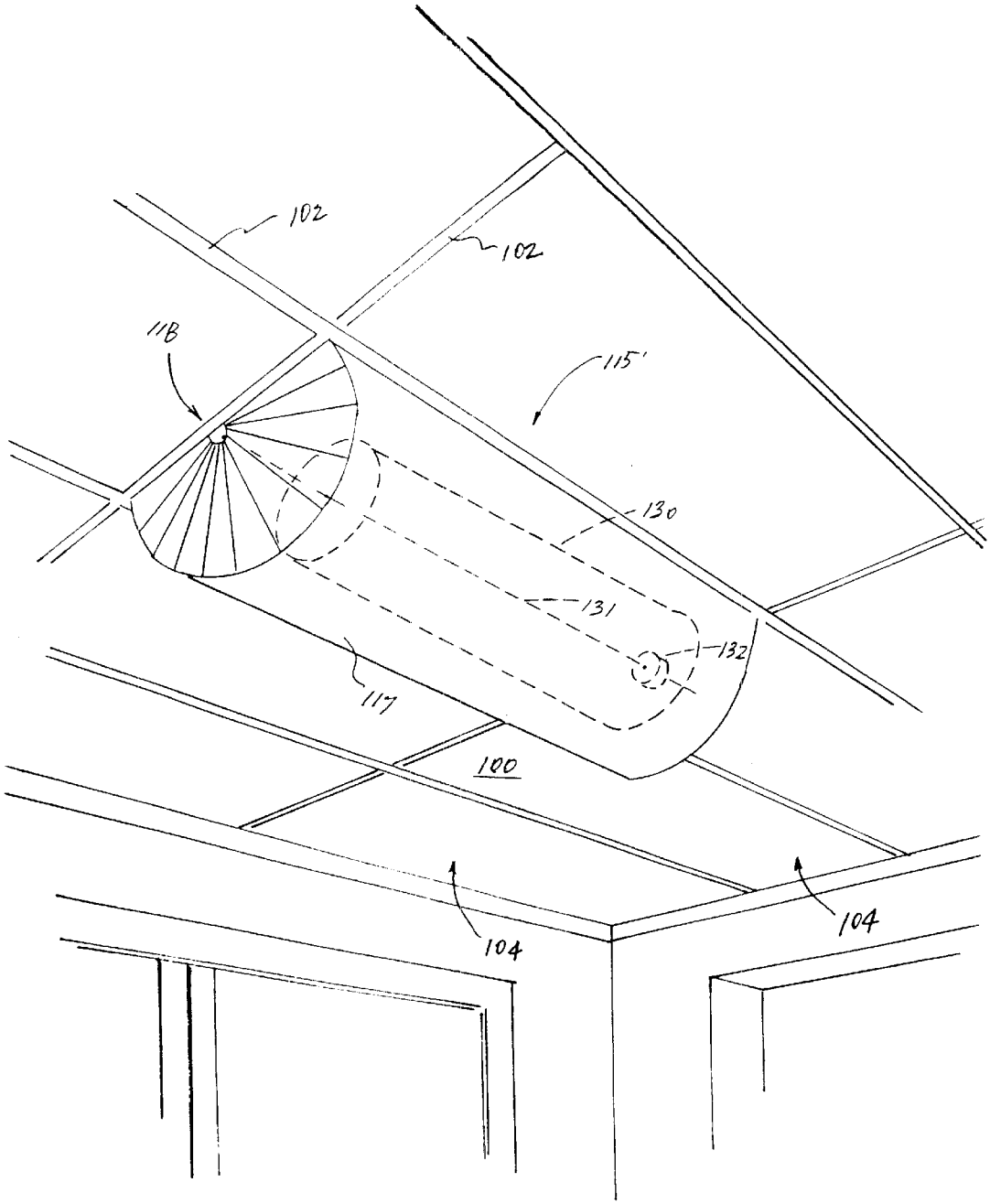
FIG. 14 is a perspective view of an alternative embodiment of the semicylindrical sign of FIG. 12 wherein a cylindrical, interactive sign element is rotatably mounted within the interior thereof.

The sign or design element 115 is also constructed of a single sheet or blank, indicated generally at 120, of a foldable, plastic material as shown in FIG. 13. Initially the blank 120 is die-cut and fold lines are scored to predetermined dimensions, which are calculated to provided the finished configuration and proper fit to the ceiling tile and light receiving areas in the suspended ceiling 100. This is accomplished in a die-cutting press with tooling set up to fabricate the blank 120 as seen in FIG. 14 and hereinafter described.

The blank 120 includes generally rectangular display surface 117. A first longitudinal edge portion (delineated by the fold line 122) of the display surface 117 is integrally connected to an adjacent longitudinal edge portion of the retaining flange 117*a* where the blank 120 is folded and pivotally connects the display surface 117 thereto.

Similarly, an opposite longitudinal edge portion (delineated by the fold line 123) of the display surface 117 is integrally connected to an adjacent longitudinal edge portion of the retaining flange 117*b* where the blank 120 is folded and pivotally connects the display surface 117 thereto.

It will be understood that the retaining flanges 117*a* and 117*b* are constructed in substantially the same manner described hereinabove for the retaining flanges 13*a* and 15*a* illustrated in FIGS. 3 and 4, and the folding sequence and assembly instructions will not be repeated here to relieve prolixity in this disclosure.

The adjacent end edges of the display surface 117 (delineated by the fold lines 124 and 125) are integrally connected to the end panels 118 and 119 where the blank is folded 90 degrees along the fold lines 124 and 125 and pivotally connects thereto.

The semicircular end panels 118 and 119 are formed by the following fold sequence. The terms "upwardly" and "downwardly" used in the following fold sequence will be understood to describe the direction of the fold relative to the plane of FIG. 14. The fold sequence will describe the folding of both end panels 118 and 119 simultaneously to relieve prolixity in this disclosure.

Each of the semicircular end panels 118 and 119 are comprised of a plurality of triangular sections 150–157 and 150'–157' respectively, which will form the outermost surface of the semicircular end panels 118 and 119. The dimensions and included angles of the sections 150–157 and 150'–157' are calculated based on the standard width of the ceiling tile and light fixture receiving areas (i. e. about 24 inches standard) and the length of the arc of the circle defined by the curved display surface 117 using trigonometric functions and the corresponding score lines are provided on the blank 120.

The subsections 160 and 160' are integrally connected to the adjacent sections 150 and 150' along the fold lines 176 and 176' where the blank is folded downwardly and pivotally connects the same.

The subsections 161 and 161' are integrally connected to the adjacent sections 150 and 150' along the fold lines 177 and 177' where the blank is folded downwardly and pivotally connects the same.

The subsections 162 and 162' are integrally connected to the adjacent subsections 161 and 161' along the fold lines 178 and 178' where the blank is folded upwardly and pivotally connects the same.

The subsections 162 and 162' are also integrally connected to the adjacent sections 151 and 151' along the fold lines 179 and 179' where the blank is folded downwardly and pivotally connects the same.

The sections 151 and 151 ' are also integrally connected to the adjacent subsections 163 and 163' along the fold lines 180 and 180' where the blank is folded downwardly and pivotally connects the same.

The subsections 163 and 163' are also integrally connected to the adjacent subsections 164 and 164 along the fold lines 181 and 181' where the blank is folded upwardly and pivotally connects the same.

The subsections 164 and 164' are also integrally connected to the adjacent sections 152 and 152' along the fold lines 182 and 182' where the blank is folded downwardly and pivotally connects the same.

This folding sequence is continued for the remaining sections 153–157 and 153–157' along the fold lines 183–198 and 183'–198' respectively until completed and will not be specifically set forth herein to relieve prolixity in the disclosure.

Upon completion of the fold sequence described hereinabove for the end panels 118 and 119, the subsections 161, 162 and 161', 162' are folded 180 degrees into face-to-face relation along fold lines 178 and 178' drawing the adjacent sections 150, 151 and 150', 151' into side-by-side relation. Next, the subsections 163, 164 and 163', 164' are folded 180 degrees into face-to-face relation along fold lines 180 and 180' drawing the adjacent sections 151, 152 and 151', 152' into side-by-side relation. Next, the subsections 165, 166 and 165', 166' are folded 180 degrees into face-to-face relation along the fold lines 181 and 181' drawing the adjacent sections 152, 153 and 152', 153' into face-to-face relation.

This folding sequence is continued for the remaining subsections 167–175 and 167'–175' along the fold lines 187–198 and 187'–198' respectively and will not be specifically set forth herein to relieve prolixity in the disclosure.

Of course, the number of radial folds formed in the end panels 118 and 119 in the sequence described hereinabove will be variable for a given application depending upon the dimensions and orientation of the sign 115 and the type of plastic material utilized.

Upon completion of the above fold sequences, the triangular sections 150–157 and 150'–157' are arranged in the semicircular configuration shown in FIG. 13. The end panels 118 and 119 may be secured in the completed configuration by the use of adhesives and plastic welding prior to shipping for the convenience of installation personnel. In the alternative, a drawstring (not shown) may be inserted through a plurality of small holes (not shown) formed in each of the subsections 160–175 and 160'175' and used to manually pull the sections 150–157 and 150'–157' into the completed semicircular configuration of the end panels 118 and 119 prior to installation.

Motion and enhanced visual interest may be imparted to the present sign system by the addition of various interactive sign elements, which are displayed in combination with the signs or display elements heretofore disclosed. For example, an interactive sign element 130 is rotatably mounted on a horizontally disposed axial shaft 131 within the interior of the modified semicylindrical sign 115' and illustrated in FIG. 14. The interactive sign element 130 is rotatably driven at low RPM by a miniature electric motor 132 powered by an integrated array of photovoltaic cells, which generate electrical voltage from light energy derived from the light fixture 110. The motor 132 is mounted at a convenient location on the light fixture 110 and is mechanically coupled to the axial shaft 131 in a known manner to rotate the sign element 130.

Since such miniature electric motors powered by an integrated array of photovoltaic cells are in a practical state of development, further detailed discussion thereof is not deemed necessary.

The cylindrical, interactive sign element 130 may also constructed of a lightweight, plastic sheet material such as TRANSVY or TRANSALLOY P-300/P-260 or other suitable material for the display of advertising indicia, graphics, reflective coatings, etc. which are visible through the display surface 117 and provide an attractive, eye-catching display. However, it will be understood that the construction of such interactive sign elements displayed in conjunction with the present media display system need not be limited to the materials and construction techniques disclosed hereinabove.

Figure 15:
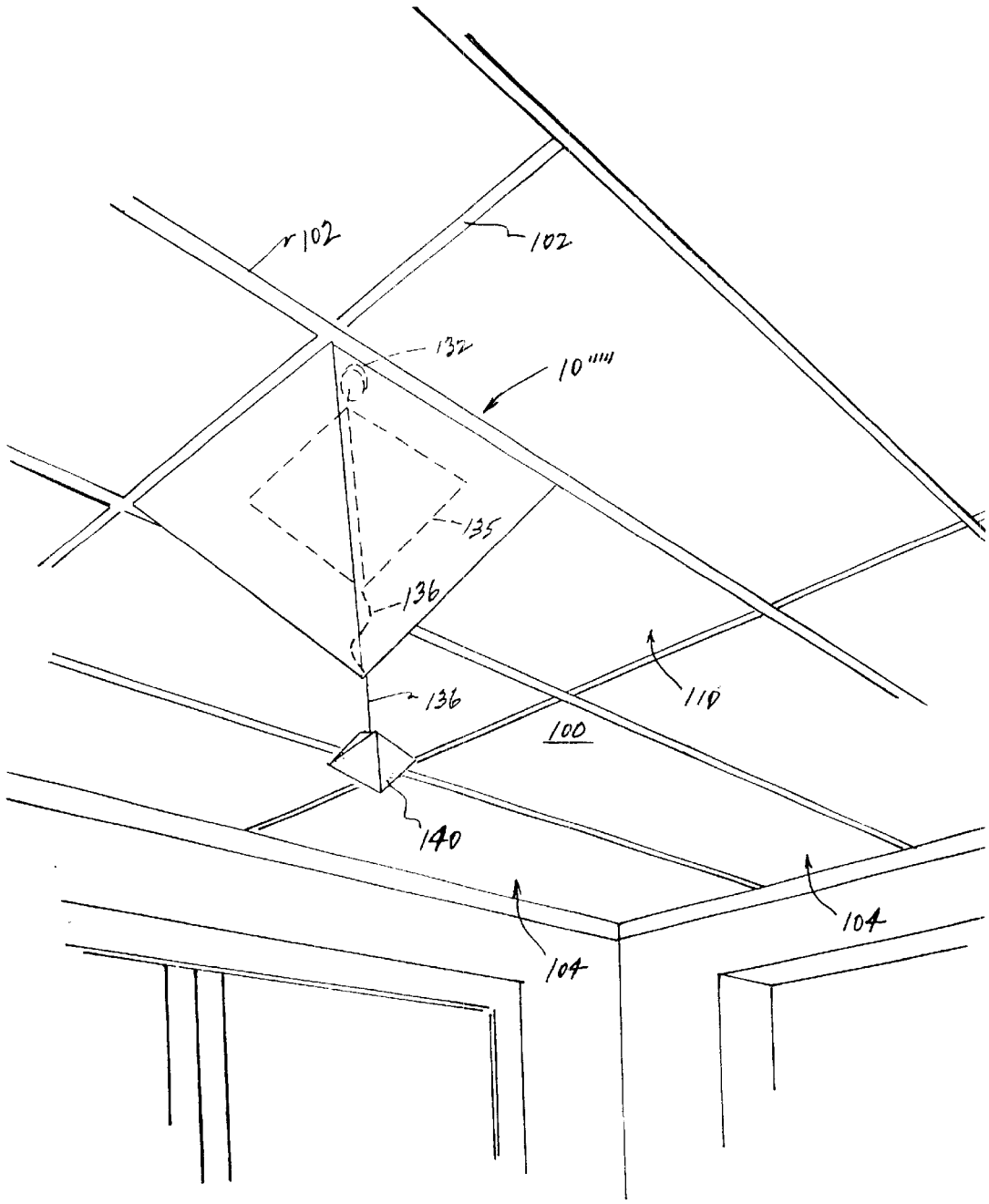
FIG. 15 is a perspective view of an alternative embodiment of the pyramidical sign of FIG. 1 wherein two interactive sign elements are rotatably attached.

Thus, any of the other heretofore disclosed signs or display elements of the present system may be displayed in combination with interactive sign elements representing the products and services of various business concerns in different forms. For example, FIG. 15 illustrates a modified pyramidical sign 10"" wherein a pyramidical-shaped interactive sign element 135 constructed in accordance with the techniques of the present system is rotatably mounted within the interior thereof. The interactive sign element 135 is fabricated from a lightweight, foldable material suitable for the display of advertising indicia and/or graphic designs. It will be understood that the sign element 135 is vertically disposed and suspended by a monofilament line 136 coupled to a miniature photovoltaic-powered motor 132, which rotates at low RPM.

In addition, an interactive sign element 140 representative of a consumer product is also attached to the monofilament line 136, but to the exterior of the sign 10"" providing added visual interest to the display. The interactive sign element 140 is constructed of any suitable lightweight material, which can be supported and rotatably displayed by sign 10"" and the miniature photovoltaically-powered motor disclosed hereinabove.

In summary, the present invention has been developed to provide an overhead media display system with multiple, interchangeable signs and display elements, which provide creative product advertising opportunities for retail stores and product vendors. The present media display system also provides consumers with product information such as the location of products and service counters within a store, brand name availability, directions to remote areas within a store, and conveys the information in an attractive, easily visible manner.

Each sign or display element is constructed of a single sheet of opaque or light transmissive material, which is folded and plastic welded to provide optimal structural strength and includes integral retaining elements for securing the sign to a suspended ceiling framework or other similar ceiling fixtures. So constructed, the signs require no additional structural support members because their structural stability is obtained by the novel folding and welding techniques disclosed herein. After being filly assembled each sign conveniently folds to a flattened condition for shipping and storage.

The signs and display elements of the present system are inexpensive to manufacture and are easily installed and removed in connection with temporary sales promotions, but are sufficiently stable and attractive to serve as point-of-presence advertising and commercial art displays.

Although not specifically illustrated in the drawings, it should be understood that additional equipment and structural components will be provided as necessary, and that all of the components described above are arranged and supported in an appropriate fashion to form a complete and operative system incorporating features of the present invention.

It is also understood that variations may be made in the present invention without departing from the scope of the invention. For example, although the present overhead media display system has been disclosed herein primarily for installation within the rectangular ceiling tile and light fixture receiving areas on suspended ceilings and similar ceiling fixtures, it will be understood that the present system is readily adaptable to other light and ceiling fixtures such as standard fluorescent light fixtures, strip lighting fixtures, track lighting fixtures, and other similar fixtures of various dimensions. Further, signs or display elements for installation on generally round light fixtures on walls and ceilings may be fabricated using die-cutting, folding, and plastic welding techniques disclosed hereinabove with minor modifications.

In addition, it will be appreciated that numerous other display element configurations and shapes not specifically disclosed herein may be constructed with alternative materials by application of the novel folding and gluing techniques in accordance with this disclosure. The integral retaining elements of the present invention are sufficiently strong that, when used with a lightweight material, the area of contact with a suspended ceiling cross-member can be reduced, enabling additional artistic possibilities. For example, it is contemplated that the numerous decorative and representational forms associated with the paper folding art of origami are adaptable for use with the present invention. In addition, other artistic display elements and commercial art designs of unlimited description are capable of being constructed and displayed using the techniques disclosed herein and are considered to be within the scope of the present invention.

Moreover, although illustrative embodiments of the invention have been described, a latitude of modification, change, and substitution is intended in the foregoing disclosure, and in certain instances some features of the invention will be employed without a corresponding use of other features. Accordingly, it is appropriate that the appended claims be construed broadly and in manner consistent with the scope of the invention.

What is claimed is:

1. An overhead media display system for attachment to suspended ceilings of the type including a framework of regularly spaced, supporting members defining ceiling tile and light fixture receiving areas and to other ceiling mounted light fixtures, said system comprising;

a plurality of interchangeable display elements each being fabricated from a single blank of a foldable material and being folded into geometric configurations having dimensions corresponding generally to said receiving areas and to said fixtures; and retaining means integrally formed within said display elements at predetermined positions thereon such that said retaining means are for engaging said supporting members to retain said display elements adjacent said ceiling tile and light fixture receiving areas, and said retaining means including retaining flanges integrally formed along opposite peripheral edges of said geometric configurations, said flanges being formed by folding portions of said blank in a predetermined folding sequence to define compressive retaining elements therein.

2. The overhead media display system of claim 1 wherein said display elements are fabricated from a light transmitting material.

3. The overhead media display system of claim 2 wherein said geometric configuration is a pyramid.

4. The overhead media display system of claim 3 wherein said geometric configuration is a modified pyramidical shape.

5. The overhead media display system of claim 2 wherein said geometric configuration is a triangular prism.

6. The overhead media display system of claim 5 wherein said geometric configuration is a modified triangular prism.

7. The overhead media display system of claim 2 wherein said geometric configuration is semicylindrical.

8. The overhead media display system of claim 1 wherein said display elements are fabricated from an opaque material.

9. The overhead media display system of claim 8 wherein said geometric configuration is a pyramid.

10. The overhead media display system of claim 9 wherein said geometric configuration is a modified pyramidical shape.

11. The overhead media display system of claim 8 wherein said geometric configuration is a triangular prism.

12. The overhead media display system of claim 11 wherein said geometric configuration is a modified triangular prism.

13. The overhead media display system of claim 8 wherein said geometric configuration is semicylindrical.

14. The overhead media display system of claim 1 wherein a plurality of said display elements are installed in an array in side-by-side relation.

15. The overhead media display system of claim 1 further including a first interactive sign element residing within an interior of said display elements and providing a display visible therethrough.

16. The overhead media display system of claim 15 wherein said first interactive sign element is adapted for rotating movement within said display elements.

17. The overhead media display system of claim 16 wherein said rotating movement is provided by a miniature electric motor including an integrated photovoltaic cell array capable of generating sufficient voltage to rotate said interactive sign element.

18. The overhead media display system of claim 17 further including a second interactive sign element mechanically coupled to said first interactive sign element and displayed externally thereof.

19. A sign for attachment to suspended ceilings of the type having a framework of regularly spaced, supporting members defining ceiling tile and light fixture receiving areas and to other ceiling mounted light fixtures, said sign comprising;

a display element fabricated from a single blank of a foldable material and being folded into a geometric configuration having dimensions corresponding generally to said receiving areas and to said fixtures; and retaining means integrally formed within said display element at predetermined positions thereon such that said retaining means are for engaging said supporting members and said fixtures to retain said display element adjacent said ceiling tile and light fixture receiving areas, and said retaining means include retaining flanges integrally formed along opposite peripheral edges of said geometric configuration, said flanges being formed by folding portions of said blank in a predetermined folding sequence to define compressive retaining elements therein.

20. The sign of claim 10 wherein said display element is fabricated from a light transmitting material.

21. The sign of claim 20 wherein said geometric configuration is a pyramid.

22. The sign of claim 21 wherein said geometric configuration is a modified pyramidical shape.

23. The sign of claim 20 wherein said geometric configuration is a triangular prism.

24. The sign of claim 23 wherein said geometric configuration is a modified triangular prism.

25. The sign of claim 20 wherein said geometric configuration is semicylindrical.

26. The sign of claim 19 wherein said display element is fabricated from an opaque material.

27. The sign of claim 26 wherein said geometric configuration is a pyramid.

28. The sign of claim 27 wherein said geometric configuration is a modified pyramidical shape.

29. The sign of claim 26 wherein said geometric configuration is a triangular prism.

30. The sign of claim 29 wherein said geometric configuration is a modified triangular prism.

31. The sign of claim 26 wherein said geometric configuration is semicylindrical.

32. A method of providing an overhead media display system comprised of a plurality of display elements including integral retaining means formed therein for attachment to a suspended ceiling of the type having a framework of regularly spaced supporting members defining ceiling tile and light fixture receiving areas, each of said display elements being fabricated from a single blank of a foldable material and being folded into a geometric configuration having dimensions corresponding generally to said receiving areas, said method comprising the steps of:

cutting said single blanks from a sheet of material having predetermined mechanical properties;

scoring said blanks to delineate a plurality of fold lines thereon corresponding to said geometric configuration including said retaining means;

folding said blanks in a predetermined folding sequence to form a plurality of planar surfaces on each blank corresponding to surface features of said geometric configuration including said retaining means; said scoring further including the steps of, laying out said retaining means adjacent one of said planar surfaces defining a peripheral supporting edge of said geometric configuration, and dividing said retaining means into four side-by-side rectangular sections delineated by first, second, third, and fourth fold lines and designated as a lower horizontal surface, an upper horizontal surface, an upper retaining element, and a lower retaining element respectively;

positioning said planar surfaces relative to one another in a predetermined relationship; and assembling said planar surfaces in said predetermined relationship to form each of said display elements.

33. A method of forming at least one integral retaining flange on a display element for attaching said display element to suspended ceilings of the type having a framework of regularly spaced supporting members defining ceiling tile and light fixture receiving areas, said display element being fabricated from a single blank of a foldable material and being folded into a geometric configuration having dimensions corresponding generally to said receiving areas, said method comprising the steps of:

cutting said single blank from a sheet of material having predetermined mechanical properties;

scoring said blank to delineate a plurality of fold lines thereon corresponding to said geometric configuration including said at least one retaining flange;

folding said blank in a predetermined folding sequence to form a plurality of planar surfaces corresponding to surface features of said geometric configuration including said at least one retaining flange;

said scoring further including the steps of, laying out said at least one retaining flange adjacent one of said planar surfaces defining a peripheral supporting edge of said geometric configuration, and dividing said at least one retaining flange into four side-by-side rectangular sections delineated by first, second, third, and fourth fold lines and designated as a lower horizontal surface, an upper horizontal surface, an upper retaining element, and a lower retaining element respectively;

positioning said planar surfaces relative to one another in a predetermined relationship; and assembling said planar surfaces in said predetermined relationship.

34. The method of claim 33 wherein the step of folding further includes the steps of:

breaking said lower horizontal surface approximately 90 degrees relative to said peripheral supporting edge along said first fold line;

bending said upper horizontal surface 180 degrees into face-to-face relation with said lower horizontal surface along said second fold line;

breaking said lower retaining element 180 degrees into face-to-face relation with said upper retaining element along said fourth fold line; and interfolding said upper and lower retaining elements between said upper and lower horizontal surfaces by folding said upper retaining element 180 degrees into face-to-face relation with said upper horizontal surface along said third fold line such that said upper and lower horizontal surfaces and retaining elements form a double thickness retaining flange having compressive characteristics.

35. The method of claim 34 wherein the step of assembling further includes the step of:

welding said upper horizontal surface to said upper retaining element and said lower retaining element to said lower horizontal surface respectively; and applying an adhesive bead between said upper and lower retaining elements along said fourth fold line to increase the compressive characteristics of said retaining flange.

* * * * *